US007497657B2

(12) United States Patent
Wang

(10) Patent No.: US 7,497,657 B2
(45) Date of Patent: Mar. 3, 2009

(54) BEAM JET PROPELLOR

(75) Inventor: Dave Wang, Taipei County (TW)

(73) Assignee: Wisepoint Tech. Co. Ltd, Taipei County (TW)

( * ) Notice: Subject to any disclaimer, the term of this patent is extended or adjusted under 35 U.S.C. 154(b) by 472 days.

(21) Appl. No.: 11/232,981

(22) Filed: Sep. 23, 2005

(65) Prior Publication Data

US 2006/0280594 A1 Dec. 14, 2006

(30) Foreign Application Priority Data

Jun. 13, 2005 (TW) ..... 94119457 A
Sep. 9, 2005 (TW) ..... 94131204 A

(51) Int. Cl.
*F04D 3/02* (2006.01)

(52) U.S. Cl. ..... 415/71; 415/72; 415/73; 416/90 R; 416/90 A; 416/176; 416/177

(58) Field of Classification Search ..... 415/71, 415/72, 73; 416/90 R, 90 A, 176, 177
See application file for complete search history.

(56) References Cited

U.S. PATENT DOCUMENTS 3,977,353 A * 8/1976 Toyama ..... 440/38
5,383,802 A * 1/1995 Nicholson ..... 440/38
5,722,866 A * 3/1998 Brandt ..... 440/67
6,470,817 B2 * 10/2002 Delfosse ..... 114/61.14

FOREIGN PATENT DOCUMENTS

JP 06191482 A * 7/1994

* cited by examiner

*Primary Examiner*—Igor Kershteyn
(74) *Attorney, Agent, or Firm*—Bacon & Thomas, PLLC

(57) ABSTRACT

A beam jet propeller is provided, especially a beam jet propeller which increases the friction force of the fluid by spiral or linear diversion protrusions or diversion grooves on the inner wall of a tube, such that original loose fluid can be twisted together into a beam shape under pressure/rotation/extrusion and form inter-tube pressure. The beam fluid may generate a strong propelling force. Meanwhile, because less air is included in this beam fluid, the bubble friction is smaller and acoustic noise is greatly decreased. The present invention does not adopt a traditional propeller as the propelling device, therefore, the cavitation due to Bernoulli theorem is not generated, and the problem of resistance force and drag force in the fluid is also eliminated. The propelling force is thus greatly increased.

12 Claims, 18 Drawing Sheets

BEAM JET PROPELLOR

BACKGROUND OF THE INVENTION

1. Field of the Invention

The present invention relates to a beam jet propellor is provided, especially a beam jet propellor which increases the friction force of the fluid by means of spiral or linear diversion protrusions or diversion grooves on the inner wall of a tube, such that original loose fluid can be twisted together into a beam shape under pressure or rotation or extrusion. The beam fluid may generate a strong propelling force.

2. Description of the Related Art

The ships advance with the engine and the propellor, but the cavitation of the propellor often causes the propellor into idle operation and the ship speed is thus slow down. According to the ⌈Bernoulli theorem⌋, the faster the rotation speed of the propellor, the smaller is the pressure of the water flow, and the water flow will evaporate. When the surface pressure of the blade of the propellor becomes lower than the vapor pressure of the sea water, a phenomenon of ⌈propellor cavitation⌋ is generated. The bubbles generated by the blades are the main cause for the vibration and acoustic noise of a ship. Serious burst of the bubbles will decrease the efficiency of the propellor, make the propellor into idle operation, and slow down the ship speed, and even gear-shaped spots will turn up on the blade of the propellor and damage the propellor.

Meanwhile, when a traditional propellor propulsor is in rotation, a resistance force face and a drag force face are generated behind the blade, slowing down the ship speed. The size of the blade of the propellor will not only generate a corresponding propelling force, but also form the resistance force face and the drag force face, a part of ship speed is thus eliminated. Additionally, the propellor is easily wrapped around and collided by miscellaneous objects in the water, thereby easily damaging the propellor.

Although the spiral propellor blade structure of the conventional International Patent Publication EP0334737 "Rotary non-positive" enhances the water flow and improves the generated resistance force and drag force, it is still a propellor-blade structure, all bad phenomena due to the abovementioned ⌈Bernoulli theorem⌋ are not overcome.

Nowadays, the main improvement in more advanced jet propulsors is to install the traditional propellor propulsor in the interior of a tube. By installing the propellor in the interior of a tube, the resistance force and the drag force generated by the propellor are therefore minimized, and the propelling speed is thereby increased. However, the jet propulsor still uses a propellor which is easily wrapped around by miscellaneous objects, bad phenomena due to the ⌈Bernoulli theorem⌋ can not be overcome, and the problem of the resistance force and the drag force is still not solved completely. A jet propulsor can not use a longer tube, a bigger pressure is thus not generated to increase the propulsion performance.

Conventional Taiwan Patents 572842, 547573, 528699, 339756 and U.S.A. Patents US005181868A and US005083435A have disclosed propulsors having different function in different ways, however these patents still use a propellor, the problems of the abovementioned prior art are therefore not solved.

SUMMARY OF THE INVENTION

In a design of the beam jet propellor of the present invention, the friction force of the fluid is increased by means of spiral or linear beam diversion protrusions or diversion grooves on the inner wall of the device, such that original loose fluid can be twisted together into a beam shape under pressure, rotation or extrusion. The beam fluid may generate a strong propelling force. Meanwhile, because less air is included in this beam fluid, the bubble friction is smaller and acoustic noise is greatly decreased. The present invention does not adopt a traditional propellor as the propelling device, therefore, the cavitation due to ⌈Bernoulli theorem⌋ is not generated, and the problem of resistance force and drag force in the fluid is also eliminated. The propelling force is thus greatly increased.

It is one object of the present invention to provide a beam jet propellor, which uses spiral or linear diversion protrusions or grooves on the inner wall of a tube to twist the fluid together into a beam shape under pressure, rotation or extrusion to generate a strong propelling force for a long time.

It is one object of the present invention to provide a beam jet propellor to increase the pressure of the fluid and the beam force by a hollow tube with an inner diameter tapering from front to back.

It is one object of the present invention to provide a beam jet propellor to generate a strong propelling force by means of a roller device, in coordination with spiral diversion protrusions or grooves on the inner wall of a tub and the inner diameter tapering from front to back of the hollow tube.

It is one object of the present invention to provide a diverter device for the beam jet propellor to achieve the purpose of turning left and right.

It is one object of the present invention to provide a fluid pressure adjuster for the beam jet propellor to adjust the fluid pressure out from the tube.

It is one object of the present invention to provide a shaft device for the beam jet propellor to roll the beam diversion hollow tube and ensure the normal operation of the beam jet propellor.

It is one object of the present invention to provide a divergence diverter device for the beam jet propellor to make the fluid move left, right, forward, etc. to achieve the purpose of changing the direction of the beam jet propellor.

It is one object of the present invention to provide a reverse propelling device for the beam jet propellor for the convenience of moving the ship in reverse. This can totally change the original movement mode of the fluid and generate a reverse propelling movement by reflection to achieve the purpose of moving the ship in reverse. The reflected fluid will not generate a back jam to reduce the propelling performance.

It is one object of the present invention to provide a beam jet propellor which can be hidden and disposed at many locations on the bottom of the ship. With the features of a roller type and a pressure type beam jet propellor and taking the advantage that it can be hidden, disposing respective parts of the beam jet propellor at many locations on the bottom of the ship can disperse the motive source of the ship, and oil and electric engine units with environmental protection concept can be introduced to work with each other to make respect motive engine units be used according to actual requirements or kinetic conditions in order to avoid over-operating these engine units and damaging them. Accordingly, the best economic performance is achieved.

It is one object of the present invention to provide a beam jet propellor which can be applied to a roller type quenching head device for fire tube, a pressure type quenching head device for fire tube, a pressurizing device for liquid or gas delivery pipe, and an enforced fluid extraction device (such as a stool), for greatly increasing the flowing performance of the fluid.

It is one object of the present invention to provide a beam jet propellor to generate a strong propelling force by means of a pressurizing device, in coordination with spiral or linear diversion protrusions or grooves on the inner wall of a tub and a hollow tube which is tapered from front to back or straight.

It is one object of the present invention to provide a multi-function beam jet propellor having the function of making a beam to generate a strong propelling force, solve the problem of vibration and acoustic noise due to the bubbles generated by a traditional propellor, and solve the phenomenon of "caviation of a propellor" due to Bernoulli theorem.

The beam jet propellor implemented according to the present invention has the following advantages:

I. Economic effects: Both ship speed and cargo-bearing capacity are properly considered 1. The space required by the beam jet propellor is less than a traditional propellor, the beam jet propellor can be reallocated to increase the space for bearing the cargo.
2. Generally, when the size of the stable wing at the board side is increased, the speed is reduced. However, the speed performance of the beam jet propellor is very high, the ship speed is still maintained at high speed even the size of the stable wing at the board side is increased.

There is a trade-off relationship between the speed and the bearing capacity in a ship using a traditional propellor.

II. Cost for maintenance is saved

1. The beam jet propellor is a hideaway type propelling device, disposed at the bottom of the ship, the whole propelling system is not exposed, it is thus not easily damaged. And when maintenance service is needed, the ship is not required to drive into a dock, a lot of time and money can be saved.
2. The beam jet propellor has a multi-layered mesh device and the tube is hollow, the disadvantage that the propellor is easily wrapped by miscellaneous objects or damaged by collision is improved.
3. The beam jet propellor has a modular structure, thus it is possible to be designed as "a main motive system" or "an auxiliary motive system" based on the motive requirement of the ship.
4. The beam jet propellor has a modular design, the operation of assembly or disassembly or maintenance or replacement is very simple, thus when it is attached by some marine living things, it can be easily disassembled for clean or maintenance, no persons need to be hired to dive into the water to process.

III. Energy consumption: The beam jet propellor can use the electricity in low speed and the oil in medium and high speed, the oil energy is thus saved.

IV. Propelling forces are dispersed

1. The beam jet propellor is separately disposed at many locations on the bottom of a ship, the motive force is not concentrated to one location at the stem. The propelling force of the ship body is balanced (e.g. a main motive force and an auxiliary motive force) by dispersing the motive force, in order to avoid the overload of the engine causing a damage or decreasing the efficiency. The concept is the same as a four wheel driven car, with the dispersion of the motive power, the motive performance at low speed, cross country driving, or hill climbing is better than that of a two wheel driven car.
2. The beam jet propellor can be implemented based the motive force requirement, such as a roller type or a pressure type, having various types and horsepower, and the best mode is obtained.
3. Also, depending on the length of the ship and the load-carrying capacity size, one or several this propelling devices can be mounted at the left side and right side of the ship beneath the waterline based on the motive force requirement.

V. Acoustic noise is reduced. The beam jet propellor only generates few bubbles, the acoustic noise is thus reduced.

VI. The effects such as excessively high pressure, counter pressure, and backflow are not occurred in the tube. Because the tube is a hollow tube having a wide head and a narrow tail and spiral diversion slices, rather than non-spiral vanes, are disposed on the inner wall of the tube, the fluid will be collected into a beam fluid and injected out from the tube tail under certain inter-tube pressure, thus the effects such as excessively high pressure, counter pressure, and backflow are not occurred in the tube under rapid rotation so as to affect the propelling force.

VII. The caviation of a propellor is not easily generated

1. The pressure of the fluid in the tube formed by twisting, or external pressure if necessary, is higher than the vapor pressure of the sea water.
2. The touching portion between the spiral diversion slices in the tube and the fluid is a face, rather than a point in the case of the propellor vanes. The fluid will completely touch a spiral line and the inter-tube pressure is higher than the vapor pressure of the sea water, the caviation of a propellor is not easily generated.

VIII. The water-floating phenomenon at the ship bottom can decrease the friction resistance force at the ship bottom and increase the speed. If a pressure type (or roller type) beam jet propellor is disposed at the bottom of the ship, in addition to the propelling force, the water-floating phenomenon is also generated at the ship bottom so as to decrease the friction force between the ship bottom and the fluid, facilitating increasing the speed.

IX. A "beam-shaped guiding fluid" forms a strong jet force. The propelling force of the beam jet propellor is not from a propellor, but from the rolling of the spiral diversion slices in the tube. The fluid is rolled and twisted together into a pressurized "beam-shaped guiding fluid", according to the principle of reflection, a strong jet force is generated.

X. The propelling efficiency is increased. The propelling force of the "beam-shaped guiding fluid" does not disperse for a long time, the propelling force is stronger than the scattered propelling force of a propellor.

XI. The ship has a streamlined design, and the beam jet propellor is hidden at the ship bottom, thus the whole shape of the ship can be designed towards the streamlined shape to meet the hydromechanics when the ship is moving. The torsion strength of the ship is also strengthened, enhancing the structure of the ship.

XII. The performance is better than a Water Jet and a traditional propellor. The tube length of a Water Jet is very short, the generated pressure is smaller, furthermore, the tube is not hollow so as to be unable to gather the fluid into a beam, and the vanes of the propellor is easily wrapped around by miscellaneous objects. Thus the performance of a Water Jet and a traditional propellor is much lower than a long-tube and hollow beam jet propellor.

XIII. A traditional propellor and a Water Jet can not overcome the Bernoulli phenomenon, however, in the case of a beam jet propellor, the fluid can be optionally pressurized externally and then sent into the hollow tube to keep as far as possible the fluid pressure higher above the vapor pressure of the sea water, therefore the Bernoulli phenomenon is overcome and the rotation speed and the propelling force thereof are increased.

The present invention provides a roller type beam jet propellor, including:

a beam diversion hollow tube having a diversion structure on the inner wall thereof, and the hollow tube has an inner diameter tapering from front to back or an equal inner diameter from front to back; and a driving device for driving the beam diversion hollow tube to rotate so as to allow the diversion structure to twist the fluid in the tube together into a beam shape and form an inter-tube pressure to generate a propelling force.

The friction force of the fluid is increased by means of spiral beam diversion protrusions or diversion grooves of the diversion structure on the inner wall of the tube. After being rotated by a driving device or introducing a pressurized fluid, original loose fluid can be twisted together into a beam shape under rotation and extrusion, and an inter-tube pressure is generated, thus the beam fluid can generate a strong propelling force. Meanwhile, because less air is included in this beam fluid, the bubble friction is smaller and acoustic noise is greatly decreased. The present invention does not adopt a traditional propellor as the propelling device, therefore, the cavitation due to ⌈Bernoulli theorem⌋ is overcome, and the problem of resistance force and drag force in the fluid is also eliminated. The propelling force is thus greatly increased.

The abovementioned roller type beam jet propellor rotates the beam diversion hollow tube by a driving device, in coordination with spiral or linear diversion protrusions or grooves on the inner wall of the tub and a hollow tube having an inner diameter tapering from front to back or a straight tube, the fluid will form an inter-tube pressure and become a beam fluid to generate a strong propelling force. In order to increase the efficiency, this device can be pressurized depending on different cases.

The abovementioned roller type beam jet propellor is a propelling device which disposes its driving device at the lateral side and drives the roller by a gear or a chain, and the fluid will enter from the front side.

The abovementioned roller type beam jet propellor is a propelling device which disposes its driving device at the front side and drives the roller directly, and the fluid will enter from the lateral side.

The abovementioned roller type beam jet propellor is a propelling device which disposes its driving device at the front side and drives the roller directly, and the fluid will enter from the front side.

The abovementioned roller type beam jet propellor provides a modular assembly device, which assembly device includes a hollow tube module, washers, screws, and a cleaning cover which can be raised at any time for the maintenance or cleaning of the beam diversion hollow tube.

The abovementioned roller type beam jet propellor provides a propelling tank and a propelling cabin. A small ship needs only a beam jet propellor, however, a medium or large ship needs to additionally install a propelling tank and a propelling cabin. For the convenience of the assembly and maintenance of the roller type beam jet propellor, the beam jet propellor is pushed into the propelling tank, then the propelling tank is pushed into the propelling cabin.

The abovementioned roller type beam jet propellor at least includes a water inlet mesh, a diverter (or divergence diverter), a fluid pressure adjuster, an air filter, a fluid switch, and a miscellaneous object shoveling device. The fluid flowing through the water inlet, the water inlet guard net is filtered through the water inlet mesh and then enters this device via a channel tube. The gas is filtered through the air filter and then enters this device via a channel tube. Thus, the liquid or the air is selected/switched depending on the environment to enter this device by the fluid switch.

The abovementioned miscellaneous object shoveling device is disposed at the inner side of a shaft support, the main object thereof is to shovel out miscellaneous objects attached on a V-shaped shaft pad in order to avoid the vibration of the beam diversion hollow tube in roll due to the collision by a foreign object or the damage of the rubber shaft and reduce the operation performance. When the beam diversion hollow tube is rolled in high speed, the fluid in the shaft will be rolled up, miscellaneous objects are caused to make a move or collision everywhere, and the performance of the beam diversion hollow tube is thus affected. Therefore, when the beam diversion hollow tube is rolled, the miscellaneous object shoveling device will shovel out miscellaneous objects attached on a V-shaped shaft pad, at the same time, the water pump is activated to pump out the fluid from the shaft, in order to guide miscellaneous objects in the fluid via a miscellaneous object introducing device and keep them in a keeping net for regular elimination. A miscellaneous object fluid discharging tube can also be used to discharge miscellaneous objects in the fluid, in order to keep the fluid in the shaft very clean to increase the performance of the beam jet propellor.

The abovementioned roller type beam jet propellor provides a diverter device for the beam jet propellor to achieve the purpose of turning left and right.

The abovementioned diverter device includes: a diverting link blade frame for connecting one or a plurality of diverting link blades in order to form a flexible hollow tube; one or a plurality of expandable bars disposed at the front of the diverter device, for making left and right turn of the rear outlet, the expandability of these expandable bars is used to drive the operation of the diverter device, making the flexible tube become a curve shape, thereby achieving the purpose of turning left or right or changing the original flowing direction.

The abovementioned diverter device may also be a divergence diverter. The divergence diverter can be turned to the middle position to stop the divergence switching board at the middle position, and a forward jet is thus obtained. This divergence diverter device can be used in a roller type beam jet propellor to make the fluid move left, right, forward, etc. to achieve the purpose of changing the direction of the beam jet propellor. However, it is more suitably used for direction change for a pressure type beam jet propellor, and can be used as an auxiliary propellor or a diverter for moving in reverse or decreasing the speed or a diverter disposed at either side of the ship.

The abovementioned roller type beam jet propellor provides a fluid pressure adjuster for the beam jet propellor to adjust the fluid pressure out from the tube in order to increase the performance of the propelling force.

The abovementioned fluid pressure adjuster has one or a plurality of expandable bars and one or a plurality of pressure adjusting blades. The beam diversion hollow tube and the diverter are connected to the fluid pressure adjuster. These expandable bars can adjust the open and close of the one or these plurality of pressure adjusting blades so as to control the fluid pressure out from the tube. When the pressure adjusting blade is descending, the tube opening is shrank, the inter-tube pressure is greatly increased, the fluid is injected out of the tube and a high speed fluid is generated. On the other hand, when the pressure adjusting blade is ascending, the inter-tube pressure is not high, the fluid is weakly injected out and a low speed fluid is thus generated. Accordingly, the fluid in a tube will have a different pressure in accordance with the tube opening size, and different fluid injecting speed is formed.

The abovementioned roller type beam jet propellor provides a driving device for the beam jet propellor to roll the beam diversion hollow tube and ensure the normal operation of the beam jet propellor. The driving device includes a driving shaft, a gear or chain, or any other motive source that can rotated a roller.

The abovementioned roller type beam jet propellor provides a reverse propelling (moving in reverse/decreasing speed) device for the beam jet propellor for the convenience of moving the ship in reverse or decreasing the ship speed. This can totally change the original movement mode of the fluid and generate a reverse propelling movement by reflection to achieve the purpose of moving the ship in reverse or decreasing the ship speed. The reflected fluid will not generate a back jam to reduce the propelling performance.

In the abovementioned roller type beam jet propellor, these spiral diversion protrusions or grooves on the inner wall of a tube include one or a plurality of protruding strips for enhancing the twisting and beaming strength of the fluid.

The abovementioned roller type beam jet propellor provides a beam jet propellor which can be hidden and disposed at many locations on the bottom of the ship. With the features of a roller type and a pressure type beam jet propellor and taking the advantage that it can be hidden, disposing respective parts of the beam jet propellor at many locations on the bottom of the ship can disperse the propelling motive force of the ship, and oil and electric engine units with environmental protection concept can be introduced to work with each other to make respect motive engine units be used according to actual requirements or kinetic conditions in order to avoid over-operating these engine units and damaging them. Accordingly, the best economic performance and the purpose of environmental protection are achieved.

The abovementioned roller type beam jet propellor provides a beam jet propellor which can be applied to a roller type quenching head device for fire tube, a pressure type quenching head device for fire tube, a pressurizing device for liquid or gas delivery pipe, and an enforced fluid extraction device (such as a stool), for greatly increasing the flowing performance of the fluid.

The present invention further provides a pressure type beam jet propellor, including:

a beam diversion hollow tube having a diversion structure on the inner wall thereof, and the hollow tube has an inner diameter tapering from front to back or an equal inner diameter from front to back; and a fluid pressurizing device connected to the beam diversion hollow tube and providing a pressurized fluid into the beam diversion hollow tube so as to allow the diversion structure to twist the fluid in the tube together into a beam shape and form an inter-tube pressure to generate a propelling force.

The friction force of the fluid is increased by means of spiral or linear beam diversion protrusions or diversion grooves of the diversion structure on the inner wall of the tube, original loose fluid can be twisted together into a beam shape under pressure/rotation/extrusion, and an inter-tube pressure is generated, thus the beam fluid can generate a strong propelling force. Meanwhile, because less air is included in this beam fluid, the bubble friction is smaller and acoustic noise is greatly decreased. The present invention does not adopt a traditional propellor as the propelling device, therefore, the cavitation due to [Bernoulli theorem] is overcome, and the problem of resistance force and drag force in the fluid is also eliminated. The propelling force is thus greatly increased. Meanwhile, this device can select/switch to depending on the environment the liquid or the air as the fluid entering this device.

The abovementioned pressure type beam jet propellor has a pressurized fluid storage tank and further connects to a pressurized fluid delivery tank.

The abovementioned pressure type beam jet propellor further at least includes a water inlet mesh, an air filter, a fluid switch, a fluid volume controller, a pressurizer, a diverter, and a fluid pressure adjuster.

The abovementioned pressure type beam jet propellor provides a modular assembly device, which assembly device includes a hollow tube module, washers, a screws, and a cleaning cover which can be raised at any time for the maintenance or cleaning of the beam diversion hollow tube.

The abovementioned pressure type beam jet propellor provides a propelling tank and a propelling cabin. A small ship needs only a beam jet propellor, however, a medium or large ship needs to additionally install a propelling tank and a propelling cabin. For the convenience of the assembly and maintenance of the pressure type beam jet propellor, the beam jet propellor is pushed into the propelling tank, then the propelling tank is pushed into the propelling cabin.

The abovementioned pressure type beam jet propellor at least includes a water inlet mesh, a diverter (or divergence diverter), a fluid pressure adjuster, an air filter, and a fluid switch. The fluid flowing through the water inlet, the water inlet guard net is filtered through the water inlet mesh and then enters this device via a channel tube. The gas is filtered through the air filter and then enters this device via a channel tube. Thus, the liquid or the air is selected/switched depending on the environment to enter this device by the fluid switch.

The abovementioned pressure type beam jet propellor provides a diverter device for the beam jet propellor to achieve the purpose of turning left and right.

The abovementioned diverter device includes: a diverting link blade frame for connecting one or a plurality of diverting link blades in order to form a flexible hollow tube; one or a plurality of expandable bars disposed at the front of the diverter device, for making left and right turn of the rear outlet, the expandability of these expandable bars is used to drive the operation of the diverter device, making the flexible tube become a curve shape, thereby achieving the purpose of turning left or right or changing the original flowing direction.

The abovementioned diverter device may also be a divergence diverter. The diverter can be turned to the middle position to stop the divergence switching board at the middle position, and a forward jet is thus obtained. This divergence diverter device can be used in a roller type beam jet propellor to make the fluid move left, right, forward, etc. to achieve the purpose of changing the direction of the beam jet propellor. However, it is more suitably used for direction change for a pressure type beam jet propellor, and can be used as an auxiliary propellor or a diverter for moving in reverse or decreasing the speed or a diverter disposed at either side of the ship.

The abovementioned pressure type beam jet propellor provides a fluid pressure adjuster for the beam jet propellor to adjust the fluid pressure out from the tube in order to increase the performance of the propelling force.

The abovementioned fluid pressure adjuster has one or a plurality of expandable bars and one or a plurality of pressure adjusting blades. The beam diversion hollow tube and the diverter are connected to the fluid pressure adjuster. These expandable bars can adjust the open and close of the one or these plurality of pressure adjusting blades so as to control the fluid pressure out from the tube. When the pressure adjusting blade is descending, the tube opening is shrank, the inter-tube pressure is greatly increased, the fluid is injected out of the tube and a high speed fluid is generated. On the other hand, when the pressure adjusting blade is ascending, the inter-tube pressure is not high, the fluid is weakly injected out and a low speed fluid is thus generated. Accordingly, the fluid in a tube will have a different pressure in accordance with the tube opening size, and different fluid injecting speed is formed.

The abovementioned pressure type beam jet propellor provides a reverse propelling (moving in reverse/decreasing speed) device for the beam jet propellor for the convenience of moving the ship in reverse or decreasing the ship speed. This can totally change the original movement mode of the fluid and generate a reverse propelling movement by reflection to achieve the purpose of moving the ship in reverse or decreasing the ship speed. The reflected fluid will not generate a back jam to reduce the propelling performance.

The abovementioned pressure type beam jet propellor provides a beam jet propellor which can be hidden and disposed at many locations on the bottom of the ship. With the features of a roller type and a pressure type beam jet propellor and taking the advantage that it can be hidden, disposing respective parts of the beam jet propellor at many locations on the bottom of the ship can disperse the propelling motive source of the ship, and oil and electric engine units with environmental protection concept can be introduced to work with each other to make respect motive engine units be used according to actual requirements or kinetic conditions in order to avoid over-operating these engine units and damaging them. Accordingly, the best economic performance and the purpose of environmental protection are achieved.

The abovementioned pressure type beam jet propellor provides a beam jet propellor which can be applied to a roller type quenching head device for fire tube, a pressure type quenching head device for fire tube, a pressurizing device for liquid or gas delivery pipe, and an enforced fluid extraction device (such as a stool), for greatly increasing the flowing performance of the fluid.

In the abovementioned pressure type beam jet propellor, these spiral or linear diversion protrusions or grooves on the inner wall of a tube include one or a plurality of protruding strips for enhancing the twisting and beaming strength of the fluid.

In the abovementioned pressure type beam jet propellor, the pressurized fluid storage tank has a pressure safety valve, when the pressure of the fluid stored in the pressurized fluid storage tank becomes too high, the pressure safety valve will discharge excess pressure for safety.

The abovementioned pressure type beam jet propellor at least includes a water inlet mesh, a diverter, a fluid pressure adjuster, an air filter, and a fluid switch. The fluid flowing through the water inlet, the water inlet guard net is filtered through the water inlet mesh and then enters this device via a channel tube. The gas is filtered through the air filter and then enters this device via a channel tube. Thus, the liquid or the air is selected/switched depending on the environment to enter this device by the fluid switch.

In the abovementioned pressure type beam jet propellor, these spiral diversion protrusions or grooves on the inner wall of a tube include one or a plurality of protruding strips for enhancing the twisting and beaming strength of the fluid.

The present invention yet further provides a beam diversion hollow tube, including:

a hollow tube having a diversion structure on the inner wall thereof, and the hollow tube has an inner diameter tapering from front to back.

The diversion structure refers to diversion protrusions or grooves on the inner wall of the tube, and the inner wall of the tube refers to the inner wall of the tube of the abovementioned hollow tube, wherein these diversion protrusions or grooves are spiral or linear.

When the fluid is passing through the hollow tube, it helps pressurize and gather the fluid by the hollow tube tapering from front to back. The friction force of the fluid is increased by means of spiral or linear beam diversion protrusions or grooves on the inner wall of the tube. After being rotated by a driving device or introducing a pressurized fluid, original loose fluid can be twisted together into a beam shape under pressure/rotation/extrusion, and an inter-tube pressure is generated.

In the abovementioned beam diversion hollow tube, these diversion protrusions or grooves on the inner wall of the beam diversion hollow tube include one or a plurality of protruding strips for enhancing the twisting and beaming strength of the fluid.

The abovementioned beam diversion hollow tube provides a modular assembly device, which assembly device includes a hollow tube module, washers, screws, and a cleaning cover which can be raised at any time for the maintenance or cleaning of the beam diversion hollow tube.

The abovementioned beam diversion hollow tube provides a beam jet propellor which can be applied to a roller type quenching head device for fire tube, a pressure type quenching head device for fire tube, a pressurizing device for liquid or gas delivery pipe, and an enforced fluid extraction device (such as a stool), for greatly increasing the flowing performance of the fluid.

DETAILED DESCRIPTION OF THE PREFERRED EMBODIMENTS

Figure 1:
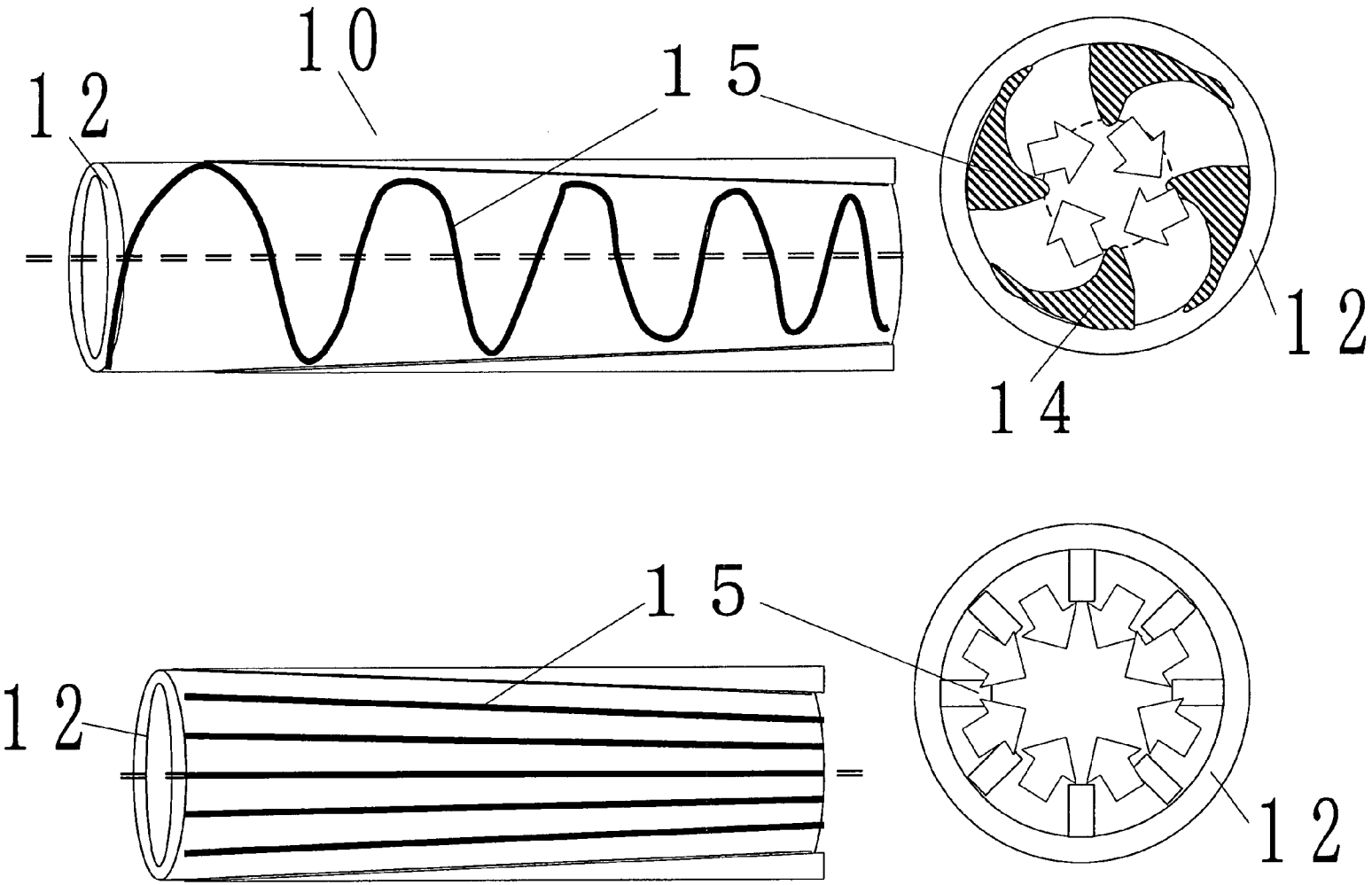
FIG. 1 shows schematic and cross-sectional views of a beam diversion hollow tube of the beam jet propellor of the present invention.

Referring to FIG. 1, schematic and cross-sectional views of a beam diversion hollow tube of the beam jet propellor 100 of the present invention are shown. The beam diversion hollow tube 10 has an inner diameter tapering from front to back for enforcing the beaming action of the fluid passing through the center, shown as the location of a dotted line, of the hollow tube 10. The wall of the tube has one or a plurality of diversion protrusions 15 on the inner wall of the tube. In one embodiment of the present invention, these diversion protrusions 15 on the inner wall of the tube are spiral, they are provided for generating a spiral beam fluid in the center within the tube when the beam diversion hollow tube 10 is rotated. And one or a plurality of protruding strips 14 are provided on these diversion protrusions 15 on the inner wall of the tube for enhancing the twisting and beaming strength of the fluid. In another embodiment of the present invention, these diversion protrusions 15 on the inner wall of the tube are linear for generating a linear beam fluid when the fluid is under pressure or extrusion.

Figure 2:
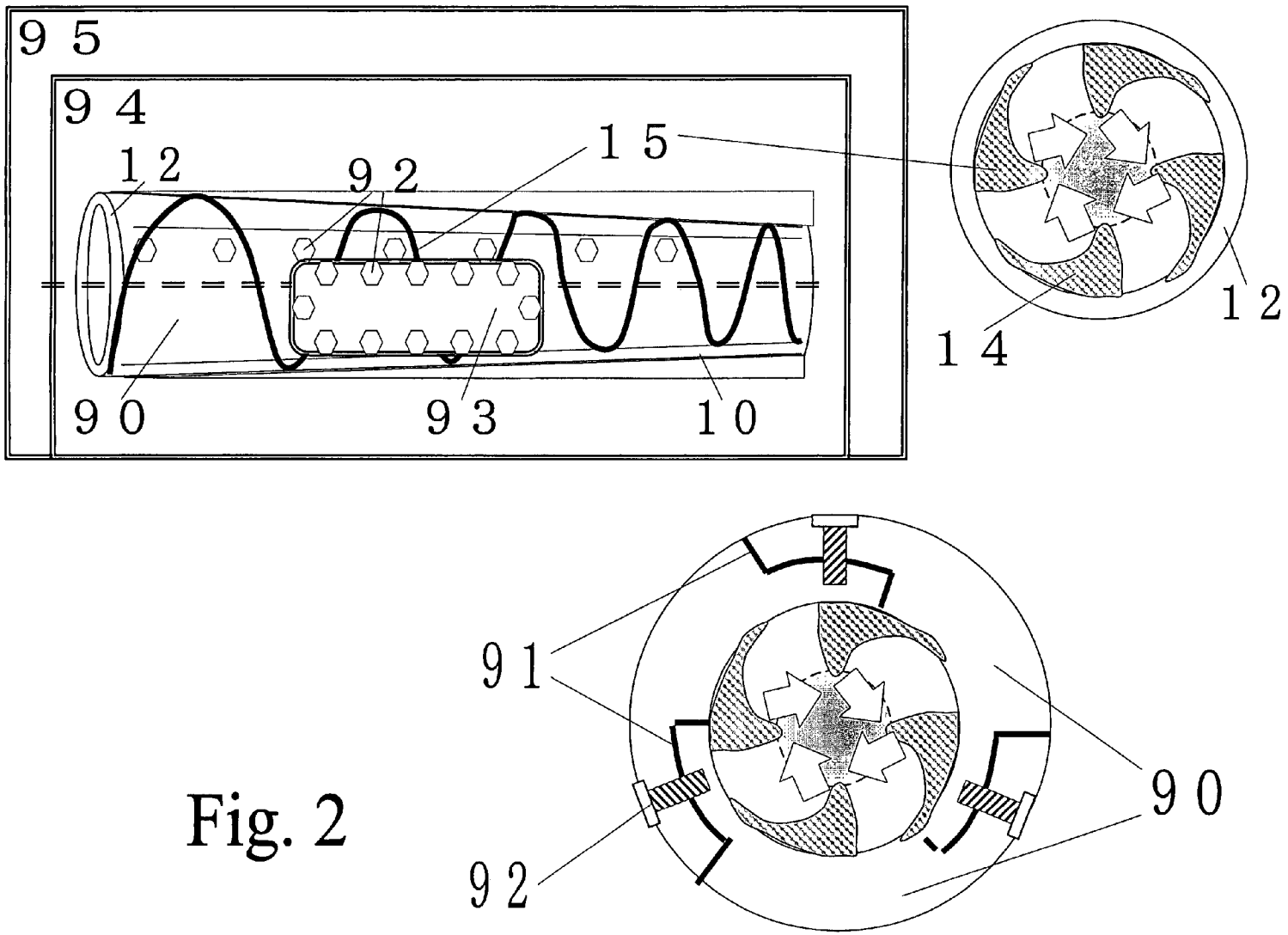
FIG. 2 shows a schematic view of the propelling tank and the propelling cabin of the beam jet propellor of the present invention and the modular structure design charts of the beam diversion hollow tube.

Referring to FIG. 2, a schematic view of the propelling tank 94 and the propelling cabin 95 of the beam jet propellor 100 of the present invention and the modular structure design charts of the beam diversion hollow tube are shown. In one embodiment of the present invention, the beam jet propellor 100 is installed within the propelling tank 94, and the propelling tank 94 is assembled within the propelling cabin 95. The propelling tank 94 is used for accommodating, protecting, checking and repairing the beam jet propellor 100. The propelling cabin 95 can be pressurized to make the inter-cabin pressure equal to the atmospheric pressure at the sea level so as to avoid the sea water at the ship bottom overflowing into the cabin when the propelling tank 94 and the propelling cabin 95 are installed at the bottom level within the ship, thereby the propelling tank 94 can be opened to do various maintenance, checking and repairing services to the beam jet propellor 100 in the ship, no persons need to be dispatched to dive beneath the waterline out of the ship and there is no need for waiting until the ship has driven into the dock, times for driving into the dock and a lot of time and money required for the maintenance service can be saved, and the loss during the down time after the ship has driven into the dock can be eliminated. The propelling tank 94 is an essential device, however, the propelling cabin 95 is or is not provided depending on the ship size, the tonnage of the ship, and the draft of the ship.

The modular structure of the beam diversion hollow tube makes the production and maintenance of the beam diversion hollow tube 10 more convenient and time saving. In the modular structure of the beam diversion hollow tube of the present invention, a washer 91 is provided between one module 90 and another module 90, then they are locked tightly by a screw 92 to combine with different modules to thus form a beam diversion hollow tube 10. In this embodiment, the illustrated beam diversion hollow tube 10 is formed by three beam diversion hollow tube modules 90 for the convenience of assembly and maintenance. At least one cleaning cover 93 is provided on one beam diversion hollow tube module 90, which can be raised at any time for the maintenance or cleaning of the beam diversion hollow tube 10 to keep the optimum operation.

Figure 3:
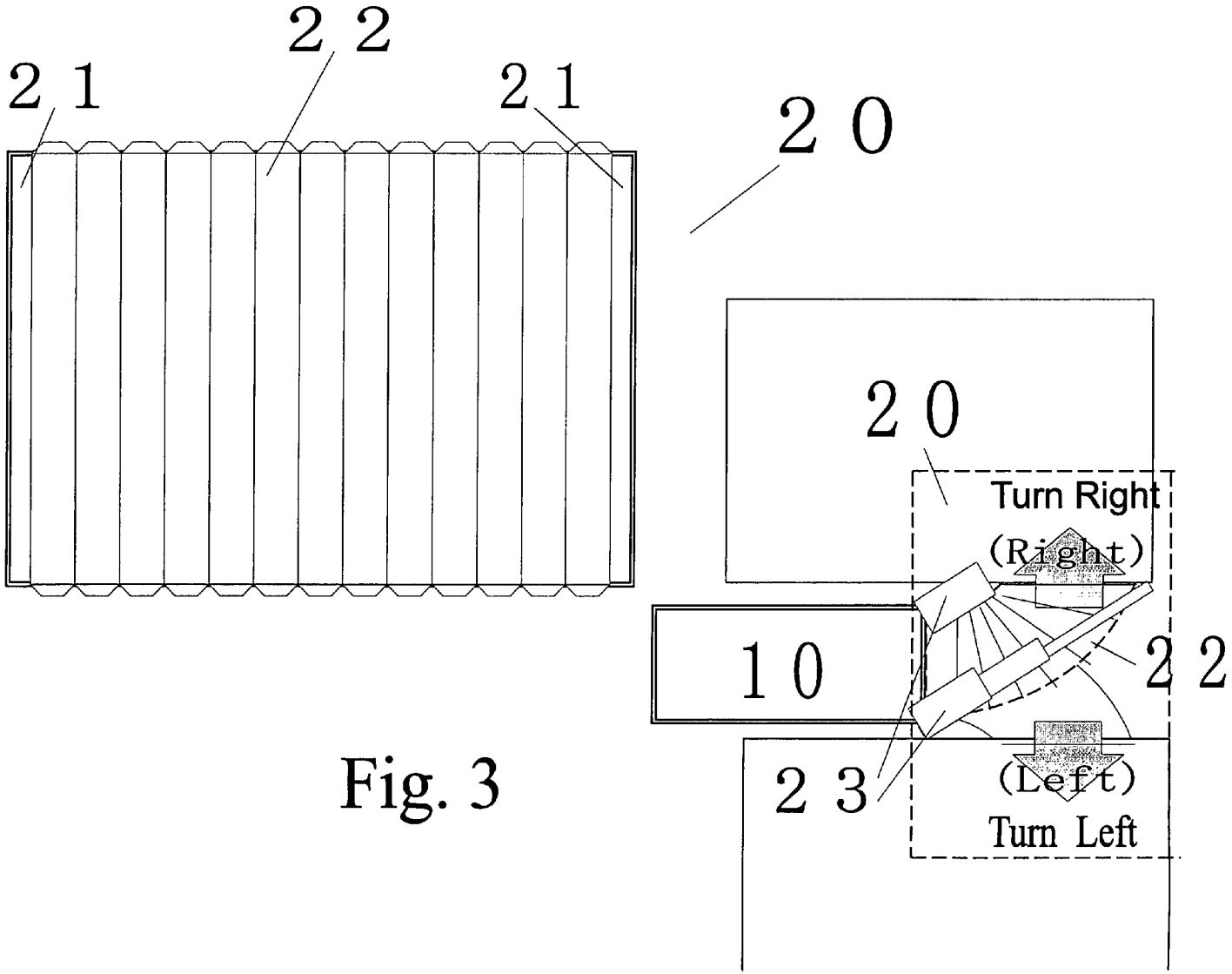
FIG. 3 shows a combination view of the beam diversion hollow tube and a diverter device of the beam jet propellor of the present invention, and a side view of the diverter device 20.

Referring to FIG. 3, a combination view of the beam diversion hollow tube 10 and a diverter device 20 of the beam jet propellor 100 of the present invention and a side view of the diverter device 20 are shown. Two diverting link blade frames are respectively provided at the front and the back of the diverter device 20 for connecting diverting link blades 22 in order to form a flexible hollow tube. One or a plurality of expandable bars 23 disposed at the front of the diverter device 20, for making left and right turn of the rear outlet of this device 20. In this embodiment, the rear end of the beam diversion hollow tube 10 is connected to the front end of the diverter device 20. By means of the expandability of these expandable bars 23 and the flexible tube formed by one or a plurality of diverting link blades 22, the diverter device 20 is driven for operation, making the flexible tube become a curve shape, thereby achieving the purpose of turning left or right or changing the original direction.

Figure 4:
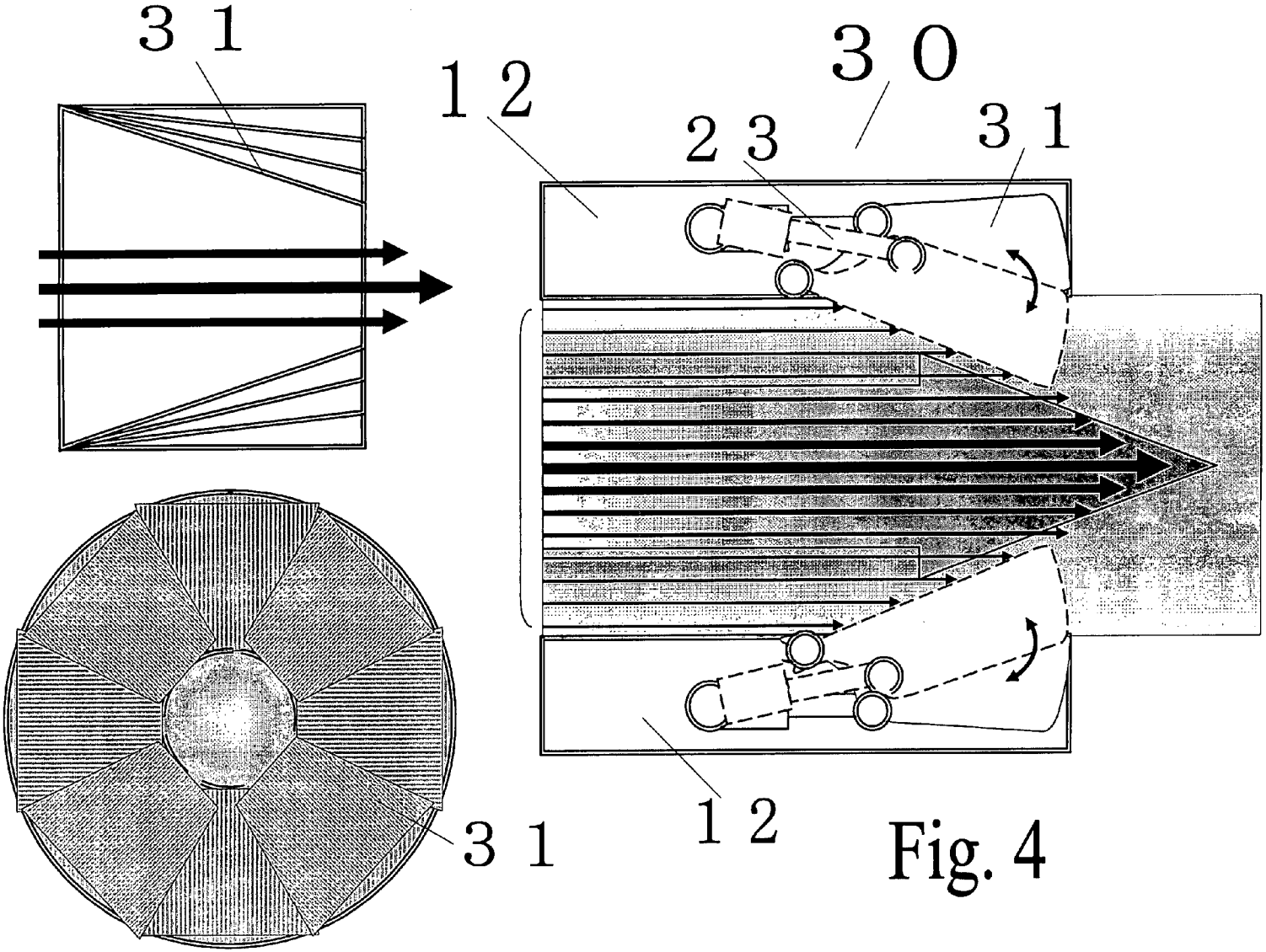
FIG. 4 shows a structural view of a fluid pressure adjuster of the beam jet propellor of the present invention.

Referring to FIG. 4, a structural view of a fluid pressure adjuster 30 of the beam jet propellor 100 of the present invention is shown. The fluid pressure adjuster 30 has one or a plurality of expandable bars 23 and one or a plurality of pressure adjusting blades 31. In the view of this one embodiment, the beam diversion hollow tube 10 is connected to the diverter device 20 and then further connected to a fluid pressure adjuster 30. These expandable bars 23 are provided within the tube wall 12 of the beam diversion hollow tube 10 for adjusting the open and close of one or a plurality of pressure adjusting blades 31 so as to form the fluid pressure out from the tube. When the pressure adjusting blade 31 is descending, the tube opening is shrank, the inter-tube pressure is greatly increased, the fluid is injected out of the tube and a high speed fluid is generated. On the other hand, when the pressure adjusting blade 31 is ascending, the inter-tube pressure is not high, the fluid is weakly injected out and a low speed fluid is thus generated. Wherein the arrows within the tube wall 12 indicate the spiral diversion direction of the fluid in the beam diversion hollow tube 10, and the propelling force of the spiral beam fluid is increased by the fluid pressure adjuster 30. Accordingly, the fluid in a tube will have a different pressure in accordance with the tube opening size, and different fluid injecting speed is formed.

Figure 5:
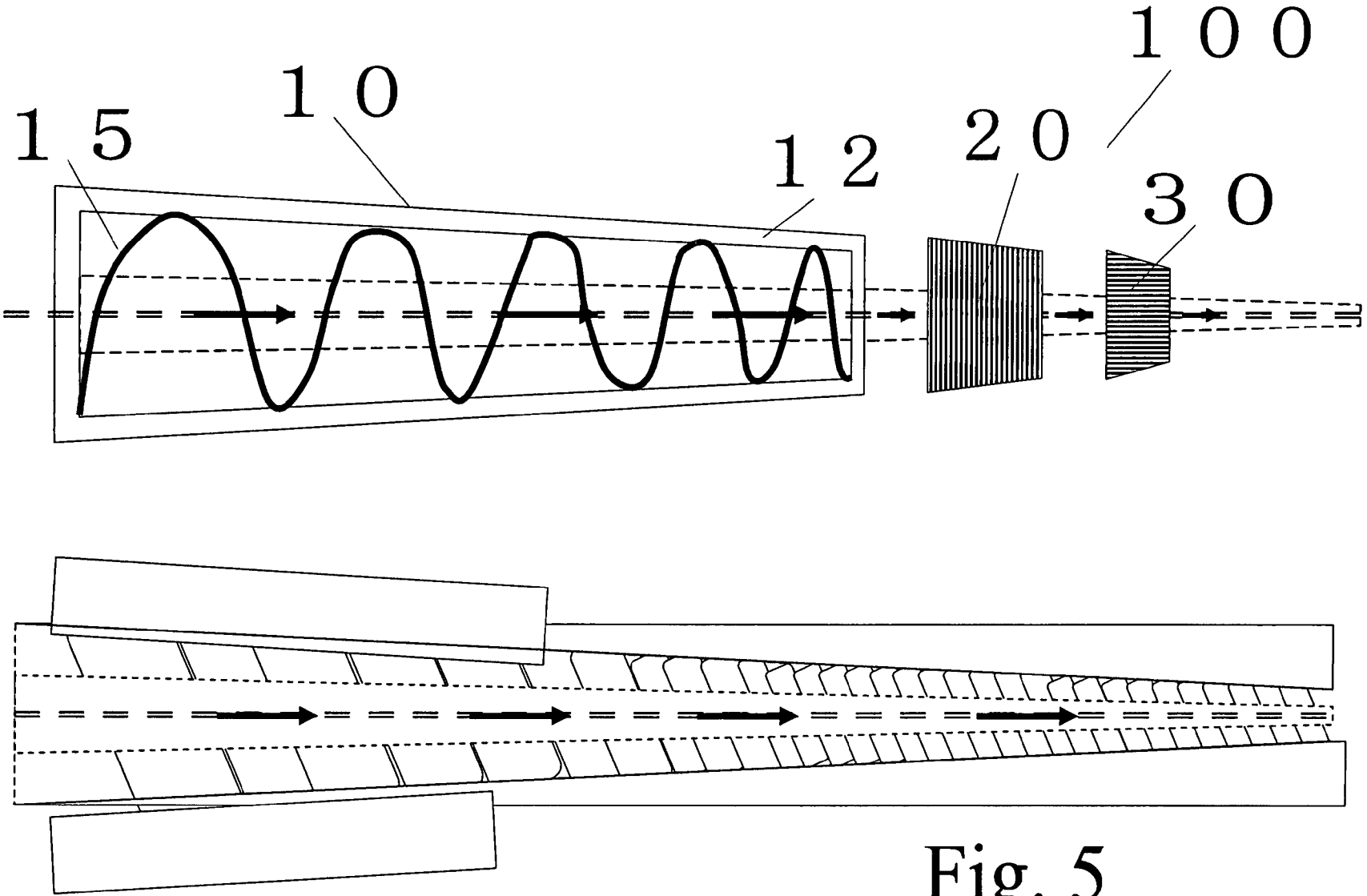
FIG. 5 shows a combination view of the beam diversion hollow tube, the diverter, and the fluid pressure adjuster of the beam jet propellor of the present invention, and a schematic view of a beam fluid in a tube.

Referring to FIG. 5, a combination view of the beam diversion hollow tube, the diverter, and the fluid pressure adjuster of the beam jet propellor 100 of the present invention and a schematic view of a beam fluid in a tube are shown. In this embodiment, the beam diversion hollow tube 10 may combine with at least one diverter 20 or general rudders for changing the direction and at least one fluid pressure adjuster 30 for adjusting the fluid pressure flowing out. Once the spiral beam fluid generated in the tube flows out of the tube, a beam-shaped guiding fluid is thus formed and a propelling force with high efficiency is generated.

In the lower view of a beam fluid in a tube in FIG. 5, oblique lines denote the beam diversion hollow tube 10 is driven to rotate and cause the fluid in the tube to become a spiral fluid, and the central dotted line denotes the propelling force of the spiral beam fluid and the direction thereof. In the inner diameter tapering from front to back, less air is included in this beam fluid after the fluid is rotated by the spiral beam diversion hollow tube 10, a guiding beam fluid is formed, the propelling force is greatly increased and silence is thus achieved.

Figure 6A:
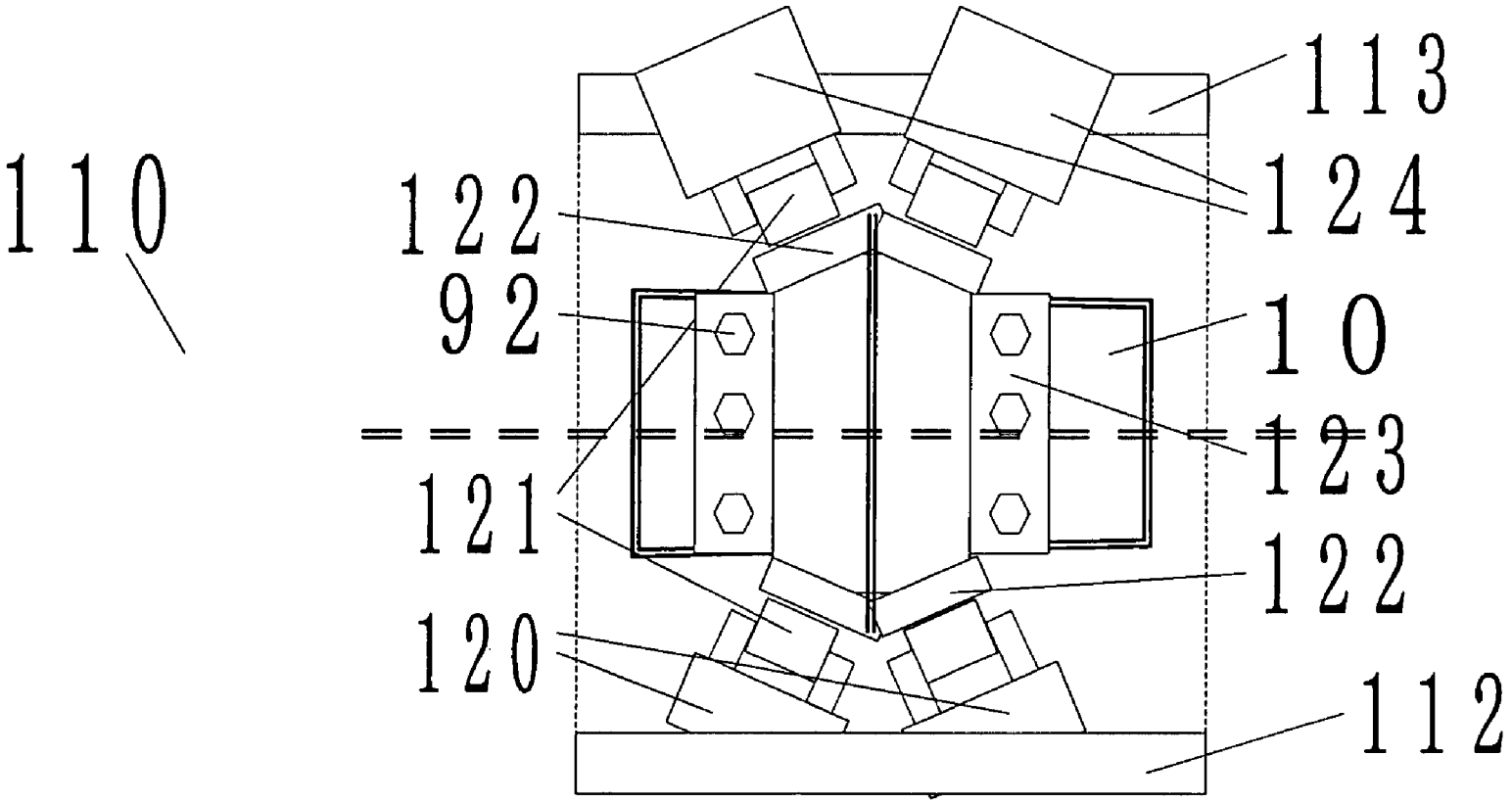
FIGS. 6A and 6B show two structural views of the shaft device of the beam jet propellor of the present invention.
Figure 6B:
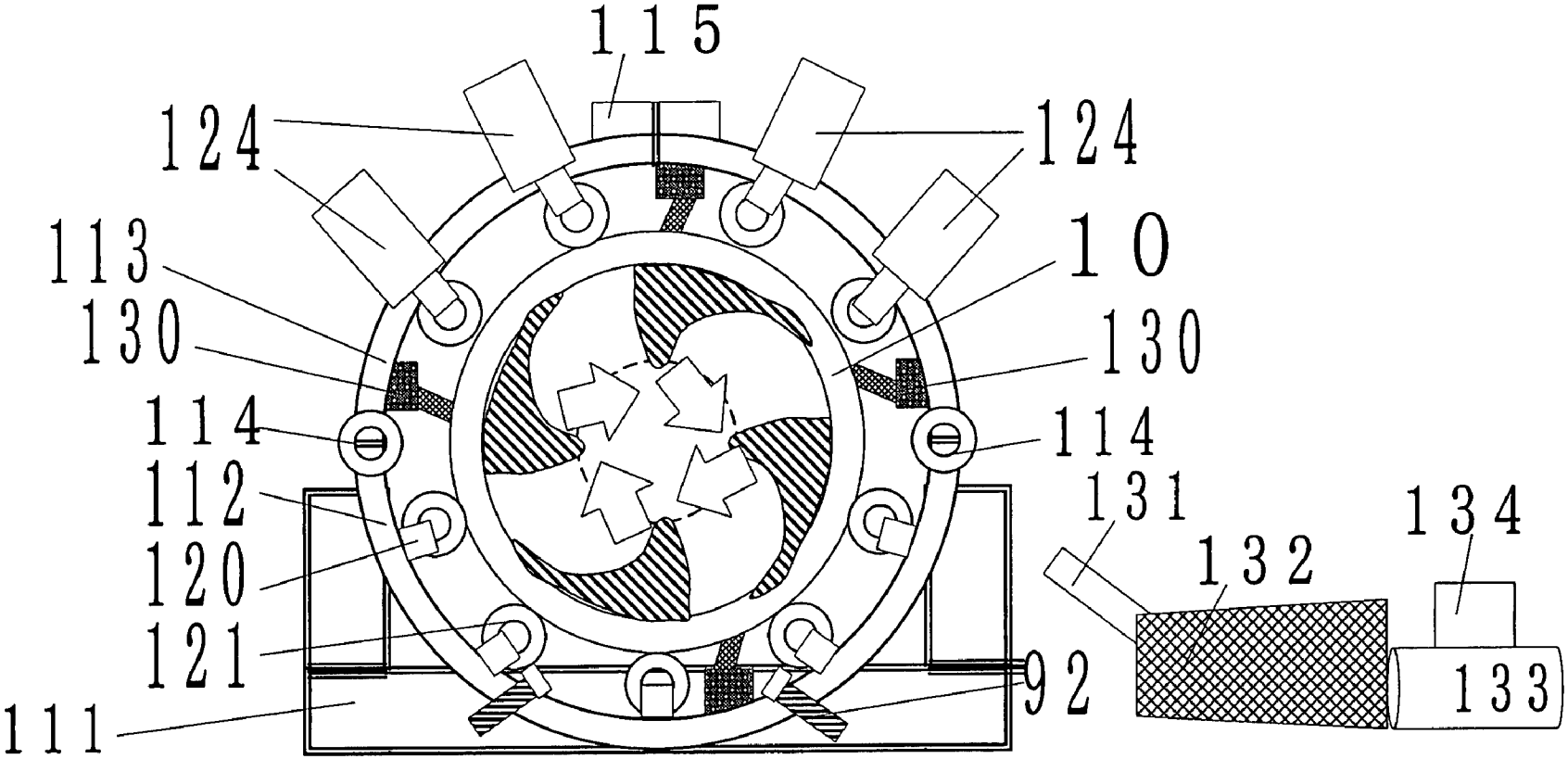

Referring to FIG. 6A and FIG. 6B, two structural views of the shaft device of the beam jet propellor 100 of the present invention are shown. The spiral beam diversion hollow tube 10 needs to be rolled in order to generate the kinetic energy of the beam-shaped fluid, so a shaft device 110 has to be additionally installed outside the beam diversion hollow tube 10 for making a roll. In this embodiment, the present invention is applied to propel a ship, screws 92 are used to lock and fix a U-shaped shaft-fixing base 111 at the bottom of a ship, and these screws 92 are used to fix a fixed shaft-fixing holder 112 on the U-shaped shaft-fixing base 111. Further, movable blades 114 are used to connect a raisable shaft-fixing holder 113 with a raisable shaft-fixing holder clip 115 in order to thus form a shaft-fixing holder 44 (shown as FIG. 7).

The fixed shaft-fixing holder 112 has one or a plurality of shaft-fixing pedestals 120. On these shaft-fixing pedestals 120, rubber shafts 121 are connected for supporting and thus rolling the beam diversion hollow tube 10. The raisable shaft-fixing holder 113 also has one or a plurality of pressurizers 124. These pressurizers 124 will connect respective rubber shafts 121 for clipping and fixing the spiral beam diversion hollow tube 10, and thus rolling the beam diversion hollow tube 10. When these rubber shafts 121 have been worn after being rolled for a long time, the center of the beam diversion hollow tube 10 is still maintained stable under rotation by means of the pressurizing of pressurizers 124, and skew rotation or the reduction of the rotating performance will not happen, or other mechanical failures are not caused.

Further, a respective screw 92 is used to lock a respective shaft-fixing ring 123 and a respective V-shaped shaft pad 122 at the outer wall of the beam diversion hollow tube 10 for closely connecting the V-shaped shaft pad 122 and the rubber shaft 121 of the shaft device 110. The main purpose of designing the V-shaped shaft pad 122 is to keep the beam diversion hollow tube 10 rolling in the groove under high speed rolling and avoid the running position or shift under rolling, in order to assure the normal operation of the beam jet propellor 100.

Again referring to FIG. 6B, a miscellaneous object shoveling device 130 is provided on the inner side of the shaft-fixing holder 44, the main purpose thereof is to shovel out miscellaneous objects attached on the V-shaped shaft pad 122 so as to avoid the vibration of the beam diversion hollow tube 10 in roll due to the collision by a foreign object or the damage of the rubber shaft 121 and reduce the operation performance. When the beam diversion hollow tube 10 is rolled in high speed, the fluid in the shaft device 110 will be rolled up, miscellaneous objects are caused to make a move or collision everywhere, and the performance of the beam diversion hollow tube 10 is thus affected. Therefore, when the beam diversion hollow tube 10 is rolled, the miscellaneous object shoveling device 130 will shovel out miscellaneous objects attached on the V-shaped shaft pad 122, at the same time, the water pump 134 is activated to pump out the fluid from the shaft device 110, in order to guide miscellaneous objects in the fluid via a miscellaneous object introducing device 131 and keep them in a keeping net 132 for regular elimination. A miscellaneous object fluid discharging tube 133 can also be used to discharge miscellaneous objects in the fluid, in order to keep the fluid in the shaft device 110 very clean to increase the performance of the beam jet propellor 100.

Figure 7:
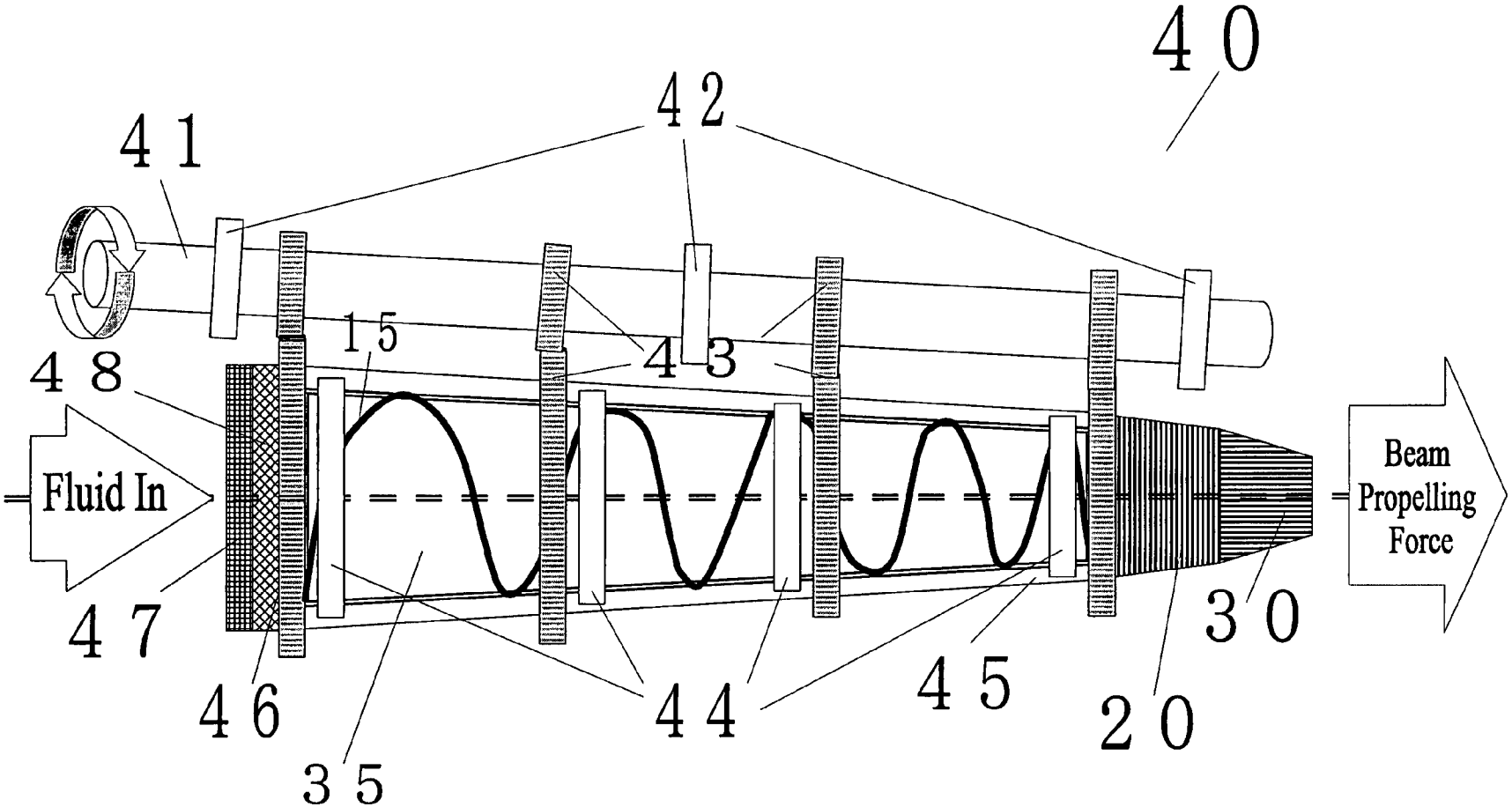
FIG. 7 shows a schematic view of the first embodiment of the roller type propelling device of the beam jet propellor of the present invention.

Referring to FIG. 7, a schematic view of the first embodiment of the roller type propelling device of the beam jet propellor 100 of the present invention is shown. The roller type beam jet propellor 40 includes a driving device 41 provided at the side. The driving device is fixed to the roller type propelling device by a driving device-fixing holder 42 and drives the roller type beam diversion hollow tube 35 by a gear 43. In this embodiment, the fluid will enter the roller type beam diversion hollow tube 35 from the front side and flow through the water inlet 46, the water inlet guard net 47, and is filtered through the water inlet mesh 48. The roller type beam diversion hollow tube 35 has an inner diameter tapering from front to back for enforcing the rotating and gathering strength of the fluid after the fluid has accepted a kinetic force and is rolled. The inner wall of the tube has one or a plurality of spiral diversion protrusions 15 on the inner wall of the tube, such that the fluid can be twisted together into a beam shape under rotation and/or extrusion and further passes through the diverter 20 and the fluid pressure adjuster 30, and then a strong propelling force is generated. The shaft-fixing holder 44 fixes the roller type beam diversion hollow tube 35 inside the roller housing 45. The inlet 49 of the pressurizing tube is used for an external pressurizing as needed by the roller type beam jet propellor 40.

Figure 8:
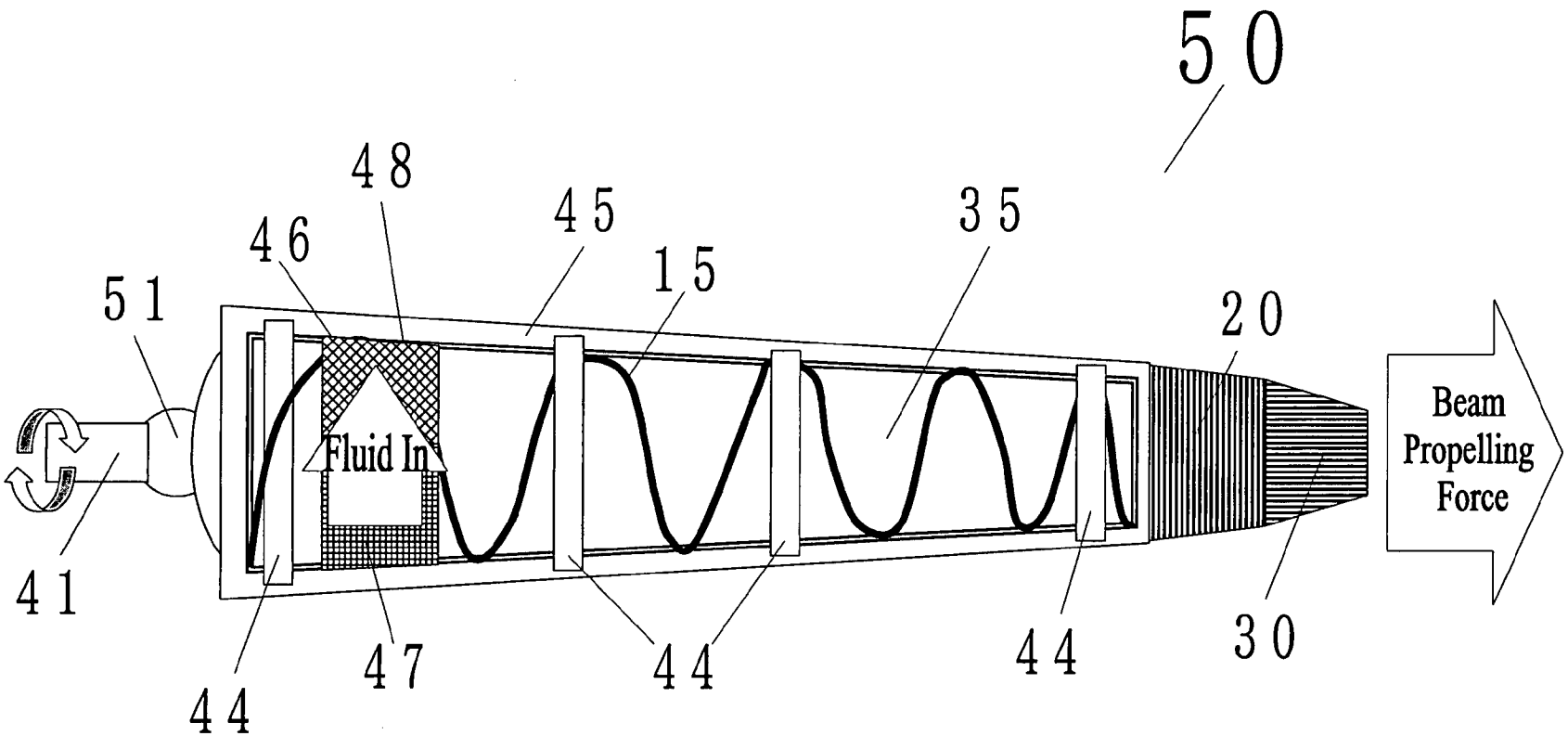
FIG. 8 shows a schematic view of the second embodiment of the roller type propelling device of the beam jet propellor of the present invention.

Referring to FIG. 8, a schematic view of the second embodiment of the roller type propelling device of the beam jet propellor 100 of the present invention is shown. The roller type beam jet propellor 50 includes a driving device 41 provided on-the roller type beam diversion hollow tube 35. In this embodiment, the fluid will enter from a lateral opening and is filtered through the water inlet mesh 48. The roller type beam diversion hollow tube 35 has an inner diameter tapering from front to back for enforcing the gathering strength of the fluid after accepting a kinetic force. The inner wall of the tube has one or a plurality of spiral diversion protrusions 15 on the inner wall of the tube, such that the fluid can be twisted together into a beam shape under rotation and/or extrusion and further passes through the diverter 20 and the fluid pressure adjuster 30, and then a strong propelling force is generated. The shaft-fixing holder 44 fixes the roller type beam diversion hollow tube 35 inside the roller housing 45. The inlet 49 of the pressurizing tube is used for an external pressurizing as needed by the roller type beam jet propellor 40.

Figure 9:
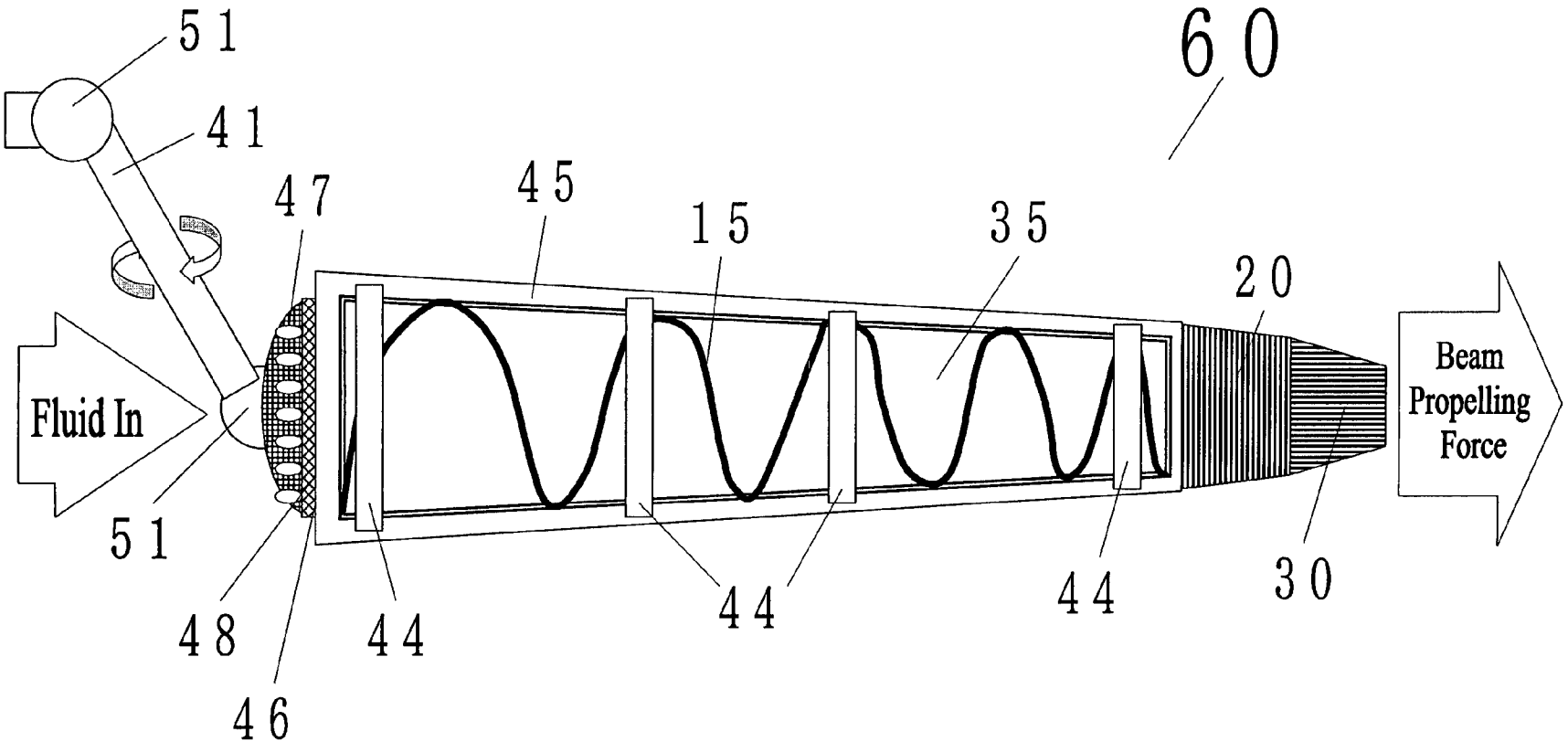
FIG. 9 shows a schematic view of the third embodiment of the roller type propelling device of the beam jet propellor of the present invention.

Referring to FIG. 9, a schematic view of the third embodiment of the roller type propelling device of the beam jet propellor 100 of the present invention is shown. The roller type beam jet propellor 60 includes a driving device 41 provided at the front side of the roller type beam diversion hollow tube 35, and the driving device 41 drives the roller type beam diversion hollow tube 35 directly by a multi direction connector 51. In this embodiment, the fluid will enter from the front opening and further passes through the water inlet 46, the water inlet guard net 47, and is filtered through the water inlet mesh 48. The roller type beam diversion hollow tube 35 has an inner diameter tapering from front to back for enforcing the gathering strength of the fluid after accepting a kinetic force. The inner wall of the tube has one or a plurality of spiral diversion protrusions 15 on the inner wall of the tube, such that the fluid can be twisted together into a beam shape under rotation and/or extrusion and then a strong propelling force is generated. The shaft-fixing holder 44 fixes the roller type beam diversion hollow tube 35 inside the roller housing 45. The inlet 49 of the pressurizing tube is used for an external pressurizing as needed by the roller type beam jet propellor 40.

Figure 10:
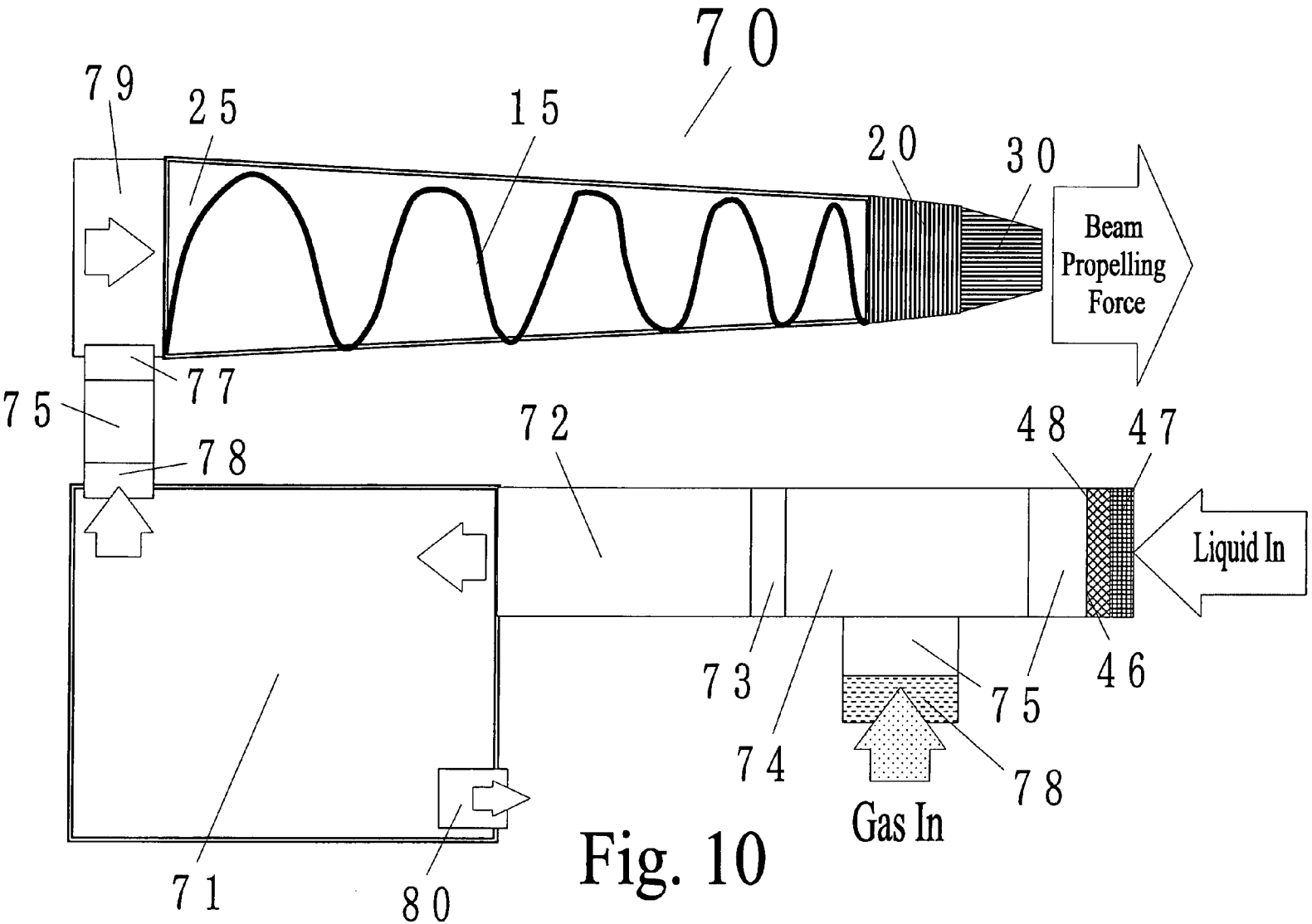
FIG. 10 shows a schematic view of the fourth embodiment of the pressure type propelling device of the beam jet propellor of the present invention.

Referring to FIG. 10, a schematic view of the fourth embodiment of the pressure type propelling device of the beam jet propellor 100 of the present invention is shown. The pressure type beam jet propellor 70 includes a pressurized fluid storage tank 71 for providing a pressurized fluid. The pressurized fluid storage tank 71 has a pressure safety valve 80, when the pressure of the fluid stored in the pressurized fluid storage tank 71 becomes too high, the pressure safety valve 80 will discharge excess pressure for safety. And the pressure type beam jet propellor 70 will deliver the pressurized fluid to the fixed beam diversion hollow tube 25 through the channel tube 75, the pressure output switch valve 76, the counter reverse flow switch valve 77, and the pressurized fluid delivery tank 79, wherein the pressurized fluid delivery tank 79 is a buffering and fixing device of the fixed beam diversion hollow tube 25. And the fixed beam diversion hollow tube 25 has an inner diameter tapering from front to back for enforcing the gathering strength of the fluid and will connect the diverter 20 and the fluid pressure adjuster 30, and then a more suitable propelling force for the fluid is generated.

In this embodiment, the fluid flowing through the water inlet 46, the water inlet guard net 47 is filtered through the water inlet mesh 48 and then enters this device via the channel tube 75. Alternatively the gas is filtered through the air filter 78 and then enters this device via the channel tube 75. Thus, the liquid or the air is selected/switched depending on the environment to enter this device by the fluid switch 74. The fluid entered this device is processed by a fluid volume controller 73 and a pressurizer 72 and sequentially enters the pressurized fluid storage tank 71 and is stored therein. The pressurized fluid storage tank 71 contains a certain volume of pressurized fluid for supplying the requirement for the pressure type beam jet propellor 70 in time. At the same time, the pressurized fluid for the roller type beam jet propellor 40/50/60 can also be supplied.

Figures 11A, 11B:
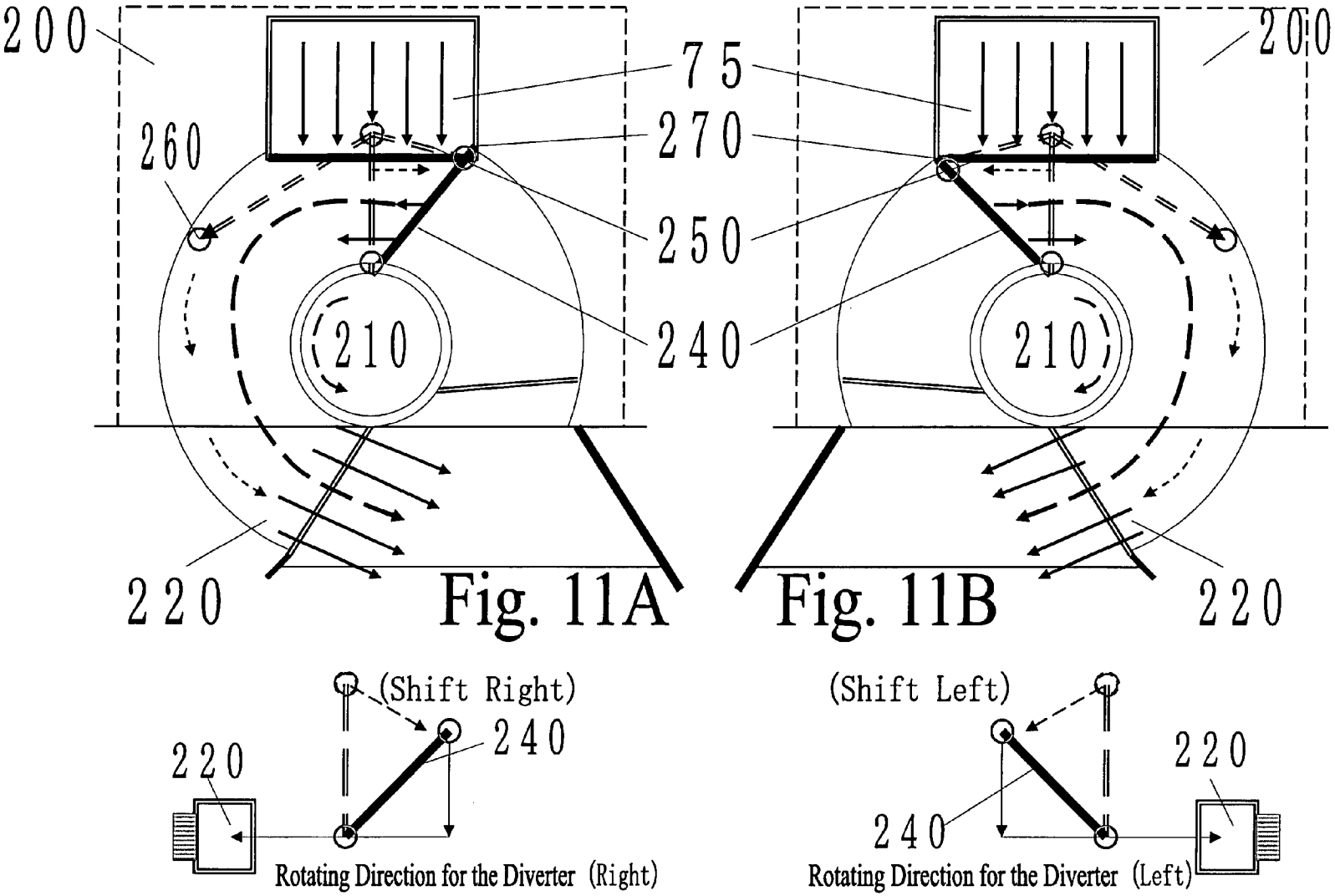
FIGS. 11A, 11B, and 11C show respective structural views of the divergence diverter of the beam jet propellor of the present invention.
Figure 11C:
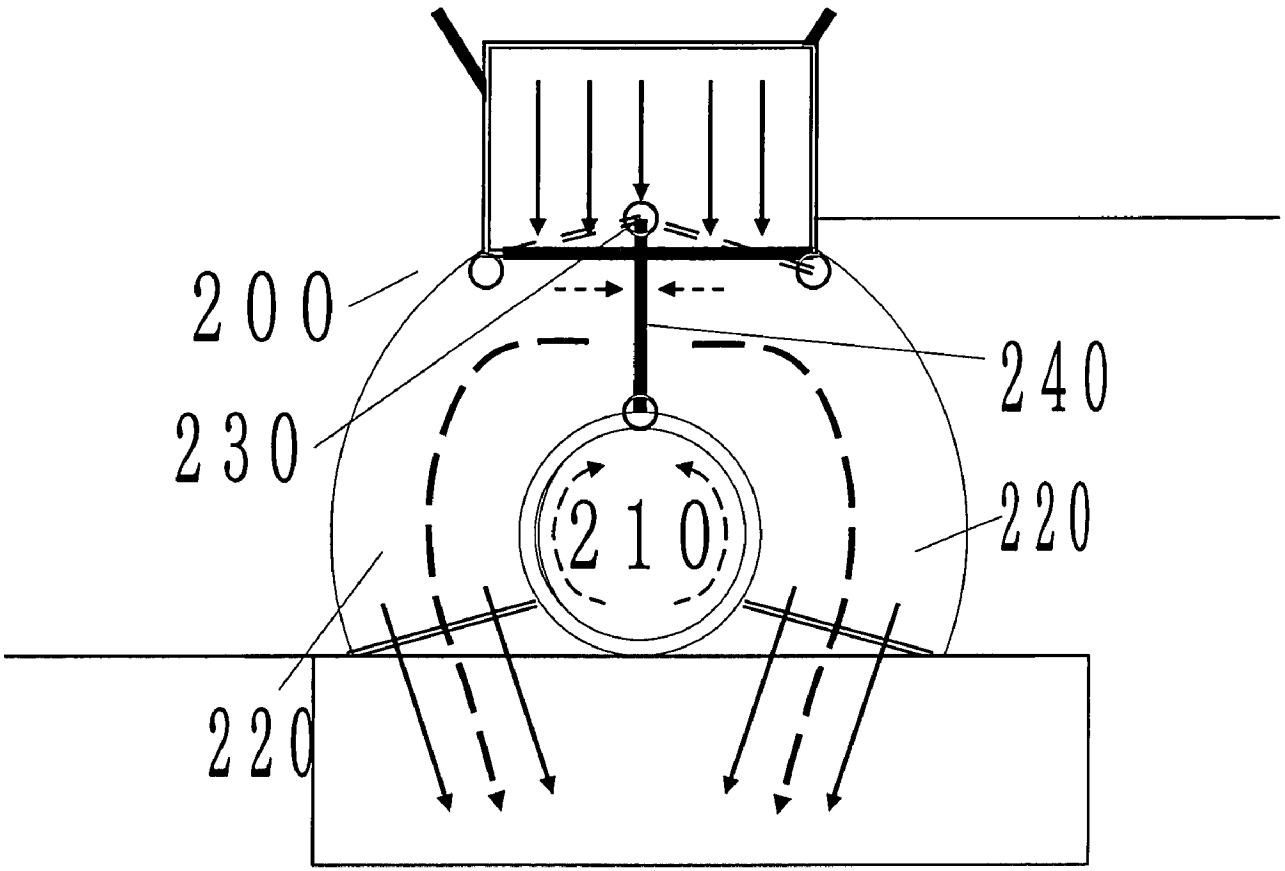

Referring to FIGS. 11A, 11B, and 11C, respective structural views of the divergence diverter device of the beam jet propellor 100 of the present invention are shown. In this embodiment, the fluid having passed through the channel tube 75 is influenced by the position of a divergence switching board 240 and then moves left, right, forward, etc. to achieve the purpose of changing the direction of the beam jet propellor 100. Referring to FIG. 11A, when a right turn is needed, the diverter 210 will rotate the divergence diverting barrel 220 leftward, the start point 260 of the divergence switching board manipulating line on the left will draw the divergence switching board manipulating line 250, and the divergence switching board manipulating line 250 will be automatically pulled via the center point 230 of the divergence switching board and the end point 270 of the divergence switching board manipulating line on the right, and then the divergence switching board 240 is pulled rightward to reach the end point 270 of the divergence switching board manipulating line. Therefore, the incoming fluid having passed through the channel tube 75 is blocked by the divergence switching board 240 and then is injected out leftward from the right side of the divergence diverting barrel 220. On the other hand, if a left turn is needed, referring to FIG. 11B, the diverter 210 can be rotated to the right side, the same processes as the above are repeated and repetitive description will be omitted here.

Further, referring to FIG. 11C, when a forward movement is needed, the diverter 210 can be rotated to the middle position to stop the divergence switching board 240 at the middle position, such that a forward injection is achieved. This divergence diverter device 200 is more suitably used for direction change for a pressure type beam jet propellor 70, and can be used as an auxiliary propellor or a diverter for moving in reverse or decreasing the speed or a diverter disposed at either side of the ship.

Figure 12A:
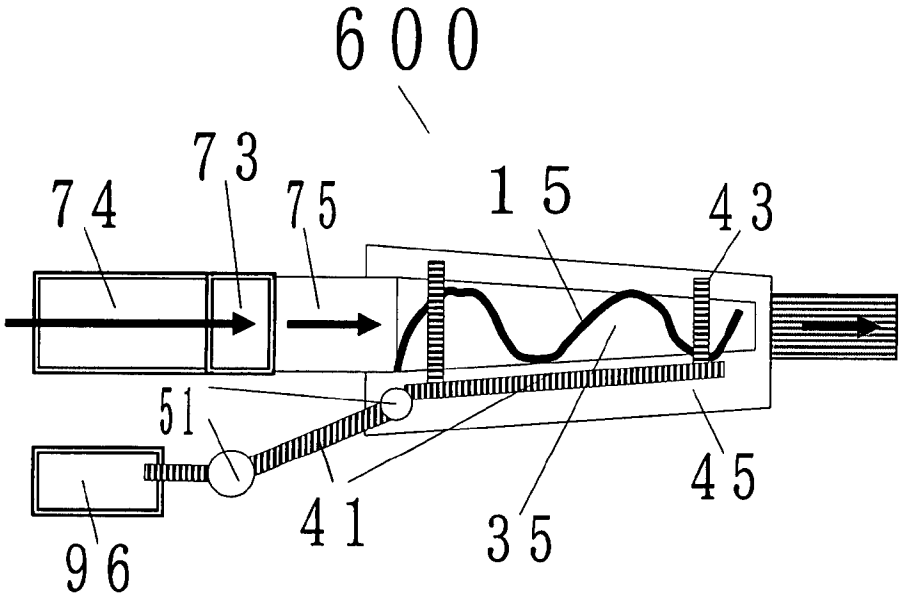
FIGS. 12A, 12B, 12C, and 12D show various applications other than in a ship of the beam jet propellor of the present invention.
Figure 12B:
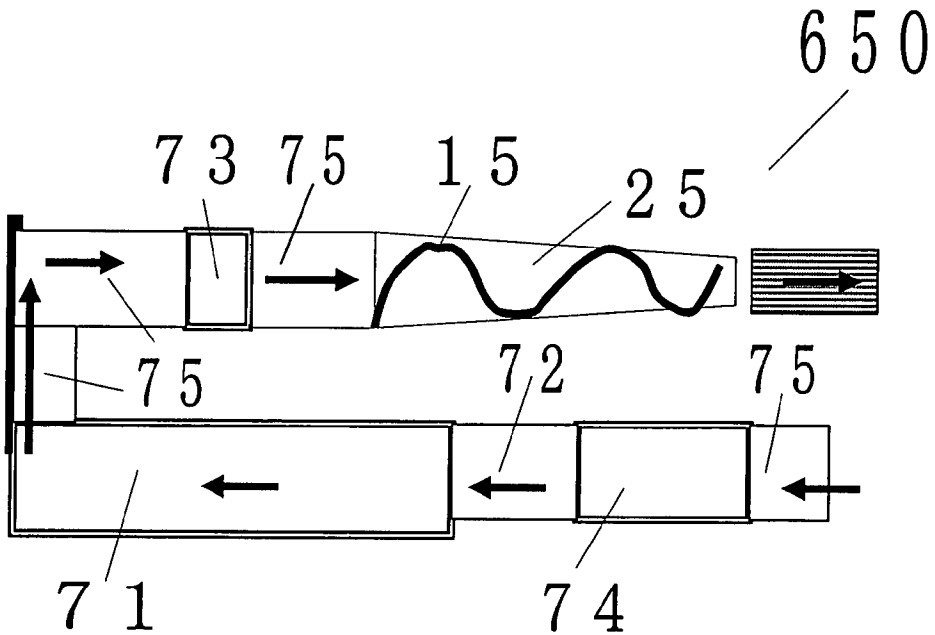
Figure 12C:
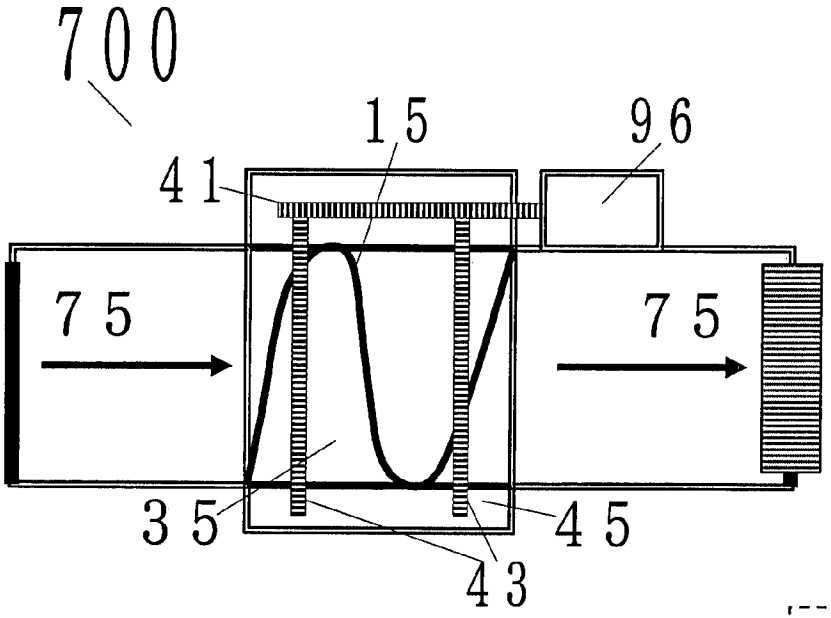
Figure 12D:
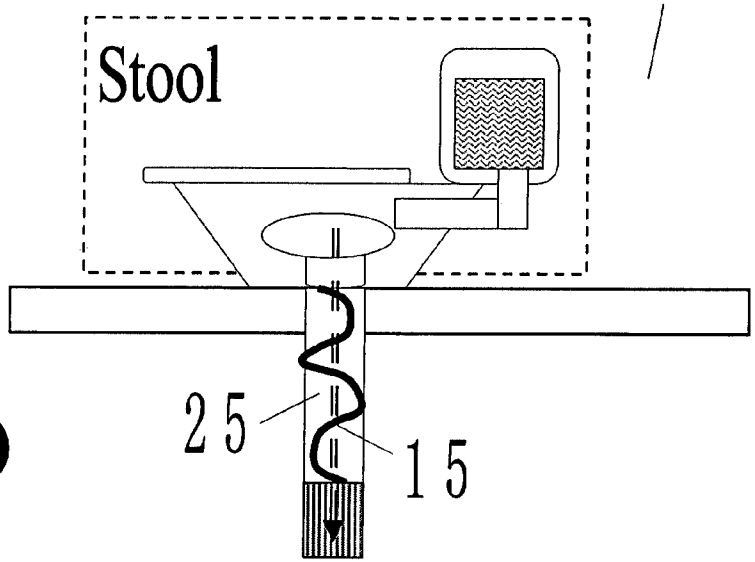

Referring to FIGS. 12A, 12B, 12C, and 12D, various applications other than in a ship of the beam jet propellor 100 of the present invention are respectively shown. As to other different embodiments, this present invention can also be applied to a roller type quenching head device for fire tube 600 (as shown in FIG. 12A), a pressure type quenching head device for fire tube 650 (as shown in FIG. 12B), a pressurizing device for liquid or gas delivery pipe 700 (as shown in FIG. 12C), and an enforced fluid extraction device 750 (as shown in FIG. 12D). The connection relationships between elements for these applications are the same as that for the above, and repetitive description will be omitted here.

Figure 13A:
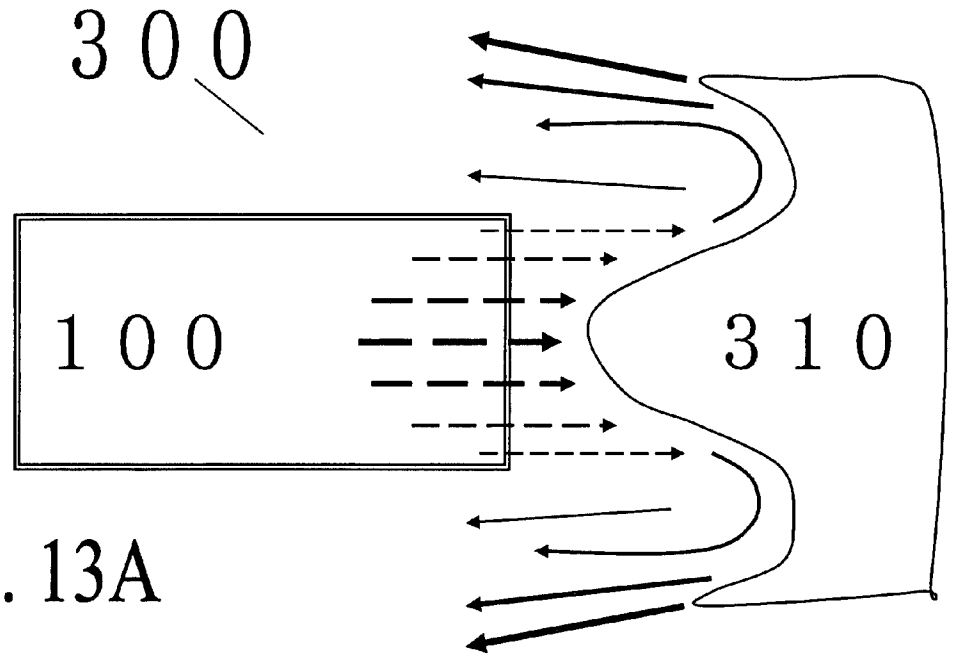
FIGS. 13A and 13B show respectively a schematic view of the reverse propelling (moving in reverse/decreasing the speed) device of the beam jet propellor of the present invention, and a structural view of the first embodiment.
Figure 13B:
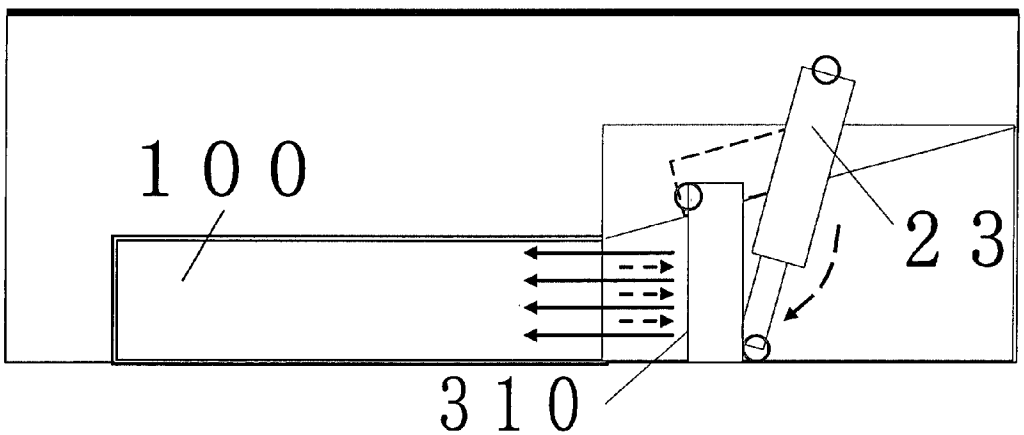

Referring to FIG. 13, a schematic view of the reverse propelling device of the beam jet propellor 100 of the present invention and a structural view of the first embodiment are shown. In this embodiment, the reverse propelling (moving in reverse/decreasing the speed) device 300 is installed at the stem of a ship, and is near the back of the beam jet propellor 100. When it is required to move the ship in reverse or decrease the ship speed, expandable bars 23 are used to lay down slowly the reverse propelling board 310. Due to the reverse propelling board 310 is near to the fluid-injecting face of the beam jet propellor 100 and has a shape of outward double concave arc in design, therefore when the injected fluid is reflected by the reverse propelling board 310, the original movement mode of the fluid is totally changed and a reverse propelling movement by reflection is generated so as to achieve the purpose of moving the ship in reverse or decreasing the ship speed. Due to the reverse propelling board 310 has a shape of outward double concave arc from the center in design, the reflected fluid will thus not generate a back jam to reduce the propelling performance.

Figure 14A:
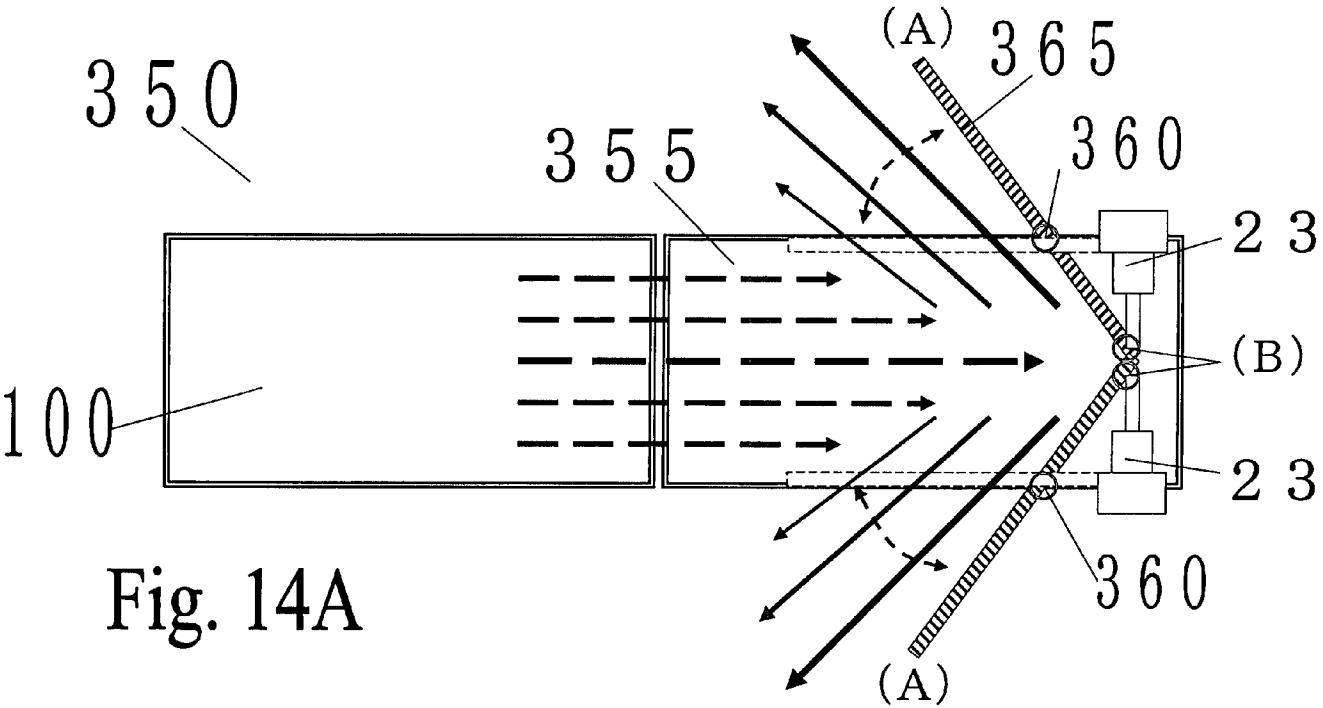
FIGS. 14A and 14B show respectively a schematic view of the reverse propelling (moving in reverse/decreasing the speed) device of the beam jet propellor of the present invention, and a structural view of the second embodiment.
Figure 14B:
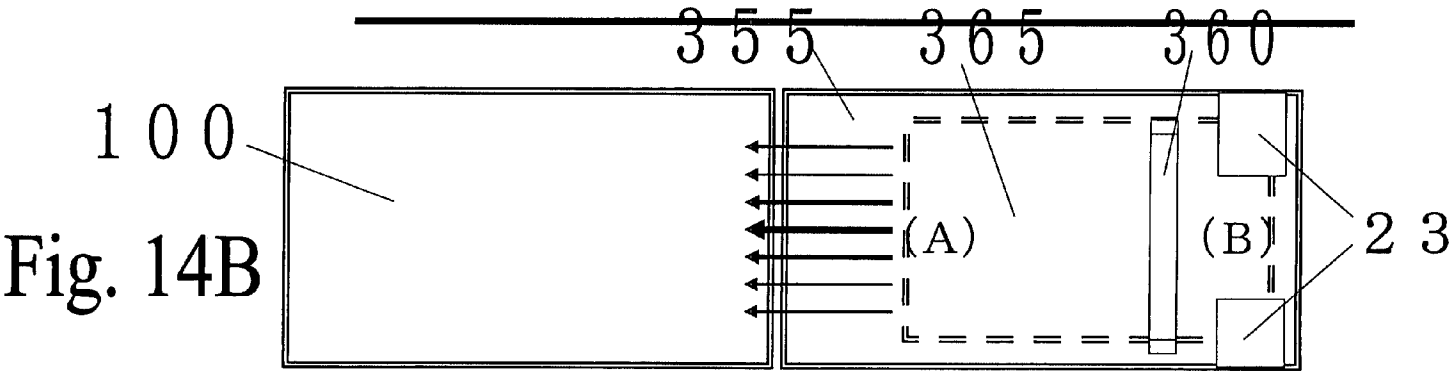

Referring to FIGS. 14A and 14B, a schematic view of the reverse propelling (moving in reverse/decreasing the speed) device of the beam jet propellor 100 of the present invention and a structural view of the second embodiment are respectively shown. In this embodiment, the reverse propelling (moving in reverse/decreasing the speed) device 350 is installed at the stem of a ship, and is near and connected to the back of the beam jet propellor 100. When it is required to move the ship in reverse or decrease the ship speed, reverse propelling boards 365 located at both sides of the hollow tube 355 will cause reverse propelling boards 365(B) to move towards the center of the hollow tube 355 by extending out rear expandable bars 23, and different angles between these reverse propelling boards 365 located at both sides are generated by reverse propelling boards 365(A) in accordance with the extending length of these expandable bars 23 from the centering axle center 360. Consequently, the fluid will flow out of the tube from both sides of the hollow tube 355, and the original flowing direction and volume size of the fluid are therefore changed. Extending out expandable bars 23 causes reverse propelling boards 365(B) to gradually approach the center of the hollow tube 355. Thus when the fluid which originally linearly flowed out is extruded inward by reverse propelling boards 365(B) at both sides, the fluid is thus forced to flow forward from the opening of reverse propelling boards 365(A) at both sides of the hollow tube 355, and the original flowing direction and volume size of the fluid are therefore changed in accordance with the angle size between these reverse propelling boards 365. Accordingly, the reverse propelling purpose is achieved by using a simple device, and the function for moving in reverse or decreasing the ship speed is thus effectively achieved.

Figure 15A:
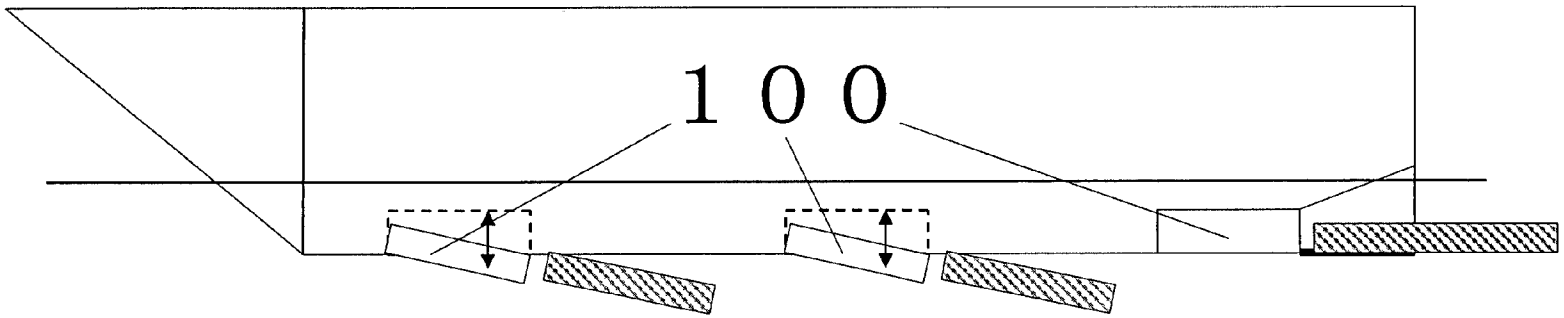
FIGS. 15A, 15B, and 15C show respectively a structural layout at the ship bottom of the beam jet propellor of the present invention, a view of a flow-guiding cutting board device, and a view of a fluid-resisting device.
Figure 15C:
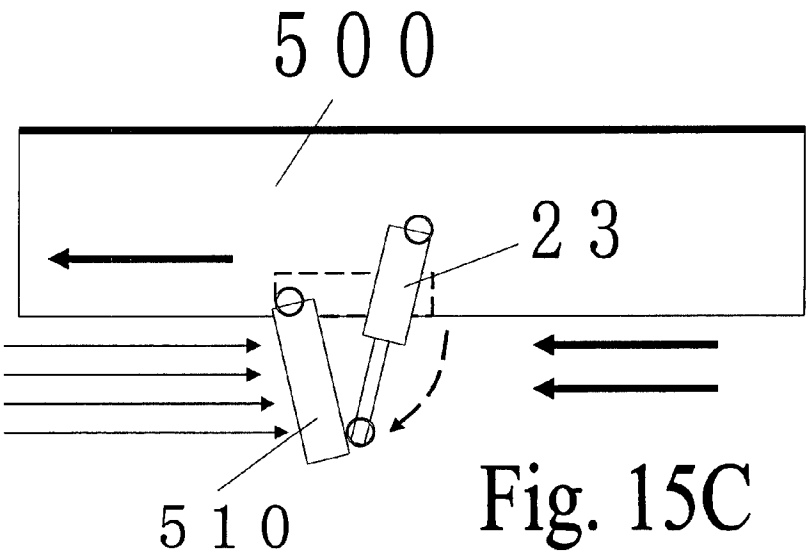
Figure 15B:
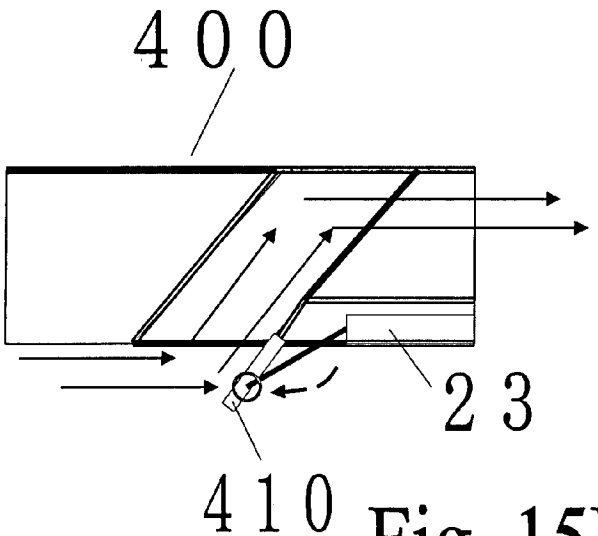

FIGS. 15A, 15B, and 15C show respectively a structural layout at the ship bottom of the beam jet propellor of the present invention, a view of a flow-guiding cutting board, and a view of a fluid-resisting device. In the embodiment of FIG. 15A, the beam jet propellor 100 can be disposed at many locations on the bottom of the ship and hidden. With the features of a roller type and a pressure type beam jet propellor and taking the advantage that it can be hidden, disposing respective parts of the beam jet propellor at many locations on the bottom of the ship can disperse the motive source of the ship, and oil and electric engine units with environmental protection concept can be introduced to work with each other to make respect motive engine units be used according to actual requirements or kinetic conditions in order to avoid over-operating these engine units and damaging them. Accordingly, the best economic performance and environmental protection performance are achieved.

Still referring to FIGS. 15B, and 15C, in accordance with the present invention, the ship bottom has a special structure of a flow-guiding cutting board device 400 and a fluid-resisting device 500. When a large amount of fluid is needed to flow in under the high speed operation of the beam jet propellor 100, the flow-guiding cutting board device 400 can fulfill the requirement. A flow-guiding cutting board 410 is provided in the back of the water inlet tube at the ship bottom. The flow-guiding cutting board 410 will extend out from the ship bottom by stretching expandable bars 23 and form an inclined face with respect to the fluid at the ship bottom. With the guiding of the flow-guiding cutting board 410, a large amount of fluid can be introduced into the tube through the water inlet from the outside of the ship, and the guiding of a large amount of fluid is thus achieved. When the guiding of a large amount of fluid is not needed, the flow-guiding cutting board 410 can be retracted back by stretching expandable bars 23.

When decreasing the ship speed is needed, the fluid-resisting device 500 can be used as an effective break assistance to achieve the purpose for decreasing the ship speed. One or a plurality of fluid-resisting devices 500 can be provided at the ship bottom or both sides of the ship as actually required. Fluid-resisting boards 510 can be opened by stretching expandable bars 23 to increase the resistive area of the flowing fluid so as to achieve the purpose of decreasing the ship speed. These resisting boards 510 can be retracted back after the ship has decreased the speed.

Although many embodiments have been described in considerable detail with reference to a ship to which the present invention is applied, the present invention is not limited to these embodiments. Instead, the present invention can also be applied to amphibious vehicles, aquatic entertainment machines, pumps, engines, compressors, turbines, and any other apparatuses or devices for increasing the propelling force.

After describing preferred embodiments of the present invention in detail, it is clearly understood to those skilled in the art that all kinds of alterations and changes can be made within the spirit and scope of the appended claims. Therefore, the spirit and scope of the appended claims should not be limited to the implementation of the preferred embodiments contained in the specification.

What is claimed is:

1. A roller type beam jet propellor, comprising:

a beam diversion hollow tube having a diversion structure on the inner wall thereof, and said hollow tube has an inner diameter tapering from front to back; and a driving device for driving said beam diversion hollow tube to rotate by means of a multi direction connector so as to allow said diversion structure to twist the fluid in the tube together into a beam shape and form an inter-tube pressure to generate a propelling force, wherein said multi direction connector is connected to the front of said beam diversion hollow tube.

2. The roller type beam jet propellor as claimed in claim 1, wherein said beam diversion hollow tube further comprises a cleaning cover at the side wall for removing miscellaneous objects in the hollow tube.

3. The roller type beam jet propellor as claimed in claim 1, wherein said beam diversion hollow tube comprises a plurality of modules.

4. The roller type beam jet propellor as claimed in claim 3, wherein washers and screws are provided for the assembly of said modules.

5. A pressure type beam jet propellor, comprising:

a beam diversion hollow tube having a diversion structure on the inner wall thereof, and said hollow tube has an inner diameter tapering from front to back; and a fluid pressurizing device connected to the front of said beam diversion hollow tube and providing a pressurized fluid filled into the front of said beam diversion hollow tube so as to allow said diversion structure to twist the fluid in the tube together into a beam shape and form an inter-tube pressure to generate a propelling force.

6. The pressure type beam jet propellor as claimed in claim 5, wherein said fluid pressurizing device further comprises a pressurized fluid storage tank for storing the pressurized fluid.

7. The pressure type beam jet propellor as claimed in claim 5, wherein said fluid pressurizing device further comprises a delivery tank for stabilizing the connection between said beam diversion hollow tube and said pressurized fluid storage tank.

8. The pressure type beam jet propellor as claimed in claim 6, wherein said pressurized fluid storage tank further comprises at least one pressure safety valve.

9. The pressure type beam jet propellor as claimed in claim 7, wherein said delivery tank further comprises at least one counter reverse flow switch valve for avoiding a reverse flow when no pressure exists in said delivery tank.

10. The pressure type beam jet propellor as claimed in claim 5, wherein said beam diversion hollow tube further comprises a cleaning cover at the side wall for removing miscellaneous objects in the hollow tube.

11. The pressure type beam jet propellor as claimed in claim 5, wherein said beam diversion hollow tube comprises a plurality of modules.

12. The pressure type beam jet propellor as claimed in claim 11, wherein washers and screws are provided for the assembly of said modules.

* * * * *